US011426044B1

(12) United States Patent
Douglas et al.

(10) Patent No.: US 11,426,044 B1
(45) **Date of Patent: *Aug. 30, 2022**

(54) CLEANING DEVICE

(71) Applicant: SharkNinja Operating LLC, Needham, MA (US)

(72) Inventors: Michael Douglas, London (GB); Samuel Emrys James, London (GB); Richard Mathias, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 160 days.

This patent is subject to a terminal disclaimer.

(21) Appl. No.: 16/718,875

(22) Filed: Dec. 18, 2019

Related U.S. Application Data

(60) Provisional application No. 62/781,436, filed on Dec. 18, 2018.

(51) Int. Cl.

| | |
|---|---|
| ***A47L 9/14*** | (2006.01) |
| ***A47L 9/12*** | (2006.01) |
| ***A47L 9/06*** | (2006.01) |
| ***A47L 9/02*** | (2006.01) |

(52) U.S. Cl.
CPC ..... *A47L 9/1409* (2013.01); *A47L 9/02* (2013.01); *A47L 9/122* (2013.01)

(58) Field of Classification Search
CPC ..... A47L 9/02; A47L 9/122; A47L 9/1409
See application file for complete search history.

(56) References Cited

U.S. PATENT DOCUMENTS

| | | | | |
|---|---|---|---|---|
| 490,472 | A | 1/1893 | Clements | |
| 2,055,734 | A | 9/1936 | Sparklin | |
| RE20,489 | E | 8/1937 | Leathers | |
| D117,388 | S | 10/1939 | Woinarovicz | |
| 3,050,761 | A | 8/1962 | Morgan | |
| D214,977 | S | 8/1969 | Roth | |
| 3,814,124 | A * | 6/1974 | Bell | F16K 15/144 137/454.2 |

(Continued)

FOREIGN PATENT DOCUMENTS

| | | |
|---|---|---|
| CN | 1764405 A | 4/2006 |
| CN | 1889881 A | 1/2007 |

(Continued)

OTHER PUBLICATIONS

International Search Report and Written Opinion received for PCT Application No. PCT/IB2020/062158, dated Mar. 24, 2021, 11 pages.

(Continued)

*Primary Examiner* — Marc Carlson
(74) *Attorney, Agent, or Firm* — Mintz Levin Cohn Ferris Glovsky and Popeo, PC; Lisa Adams

(57) ABSTRACT

Apparatus and method for receiving and holding debris in a collection chamber of a vacuum cleaner. The collection chamber has an inlet opening through which debris-entrained air enters the collection chamber. When the vacuum cleaner is off, an internal valve prevents debris from leaving the collection chamber through the inlet opening. The internal valve is movable from a first sealed position, in which the internal valve covers the chamber inlet opening, to a second unsealed position in which the internal valve does not cover the chamber inlet opening.

13 Claims, 18 Drawing Sheets

(56) References Cited

U.S. PATENT DOCUMENTS 4,011,624 A * 3/1977 Proett ..... A47L 5/24 15/350
4,063,326 A 12/1977 Fromknecht
D247,949 S 5/1978 Tillinghast et al.
D250,245 S 11/1978 Bebb
D278,099 S 3/1985 Evans
4,545,794 A 10/1985 Himukai
4,610,047 A 9/1986 Dick et al.
4,706,327 A 11/1987 Getz et al.
5,365,881 A 11/1994 Sporn
5,664,285 A 9/1997 Melito et al.
5,829,090 A 11/1998 Melito et al.
D423,157 S 4/2000 Hodges
6,102,278 A 8/2000 Rothas
6,117,200 A 9/2000 Berg et al.
6,453,506 B1 9/2002 Summer
6,571,421 B1 6/2003 Sham et al.
6,797,357 B2 9/2004 Fereshtehkhou et al.
6,799,351 B2 10/2004 Porath
6,966,098 B2 11/2005 Sako et al.
7,013,528 B2 3/2006 Parker et al.
7,048,804 B2 5/2006 Kisela et al.
7,137,169 B2 11/2006 Murphy et al.
7,150,069 B2 12/2006 Hori et al.
D548,907 S 8/2007 Killen
7,293,322 B2 11/2007 Matousek et al.
7,329,294 B2 2/2008 Conrad
7,337,494 B2 3/2008 Baer et al.
7,409,745 B2 8/2008 Dodson et al.
7,418,763 B2 9/2008 Shaver et al.
7,451,519 B2 11/2008 Nishinaka et al.
D597,717 S 8/2009 Rosenzweig et al.
7,673,361 B2 3/2010 Policicchio et al.
7,676,877 B2 3/2010 Policicchio et al.
7,861,351 B2 1/2011 Ho
7,934,287 B2 5/2011 De Soto-Burt et al.
8,020,236 B2 9/2011 Kaleta et al.
8,062,398 B2 11/2011 Luo et al.
8,065,778 B2 11/2011 Kim et al.
D661,034 S 5/2012 Ediger et al.
D672,107 S 12/2012 Van Landingham, Jr. et al.
8,341,802 B2 1/2013 Kim et al.
8,458,850 B2 6/2013 Kasper et al.
8,495,781 B2 7/2013 Dingert
8,584,309 B2 11/2013 Santiago
D703,407 S 4/2014 Xiong
8,769,764 B2 * 7/2014 Crouch ..... A47L 5/30 15/246.2
D731,137 S 6/2015 Colangelo
D764,127 S 8/2016 Vicari et al.
D766,584 S 9/2016 Blouin et al.
9,504,366 B2 11/2016 Kasper et al.
9,545,180 B2 1/2017 Conrad
9,560,944 B2 2/2017 Grey
9,661,968 B2 5/2017 Bradbury
9,788,695 B2 10/2017 Wood
D804,123 S 11/2017 Orsino
9,883,780 B2 2/2018 Kim et al.
9,901,231 B2 2/2018 Tibberts
D817,574 S 5/2018 Libman et al.
10,952,580 B1 * 3/2021 Kim ..... A47L 9/0686
10,959,584 B1 * 3/2021 Mathias ..... A47L 9/0666
2003/0159230 A1 8/2003 Oh
2003/0217432 A1 11/2003 Oh et al.
2003/0221274 A1 12/2003 Makhija et al.
2004/0045126 A1 3/2004 Parker et al.
2004/0134016 A1 * 7/2004 Kisela ..... A47L 9/2836 15/320
2004/0134025 A1 7/2004 Murphy et al.
2004/0139572 A1 7/2004 Kisela et al.
2004/0141798 A1 7/2004 Garabedian, Jr. et al.
2004/0168281 A1 9/2004 Sako et al.
2004/0211022 A1 10/2004 Fan
2004/0250376 A1 * 12/2004 Hori ..... A47L 5/225 15/403
2005/0115409 A1 6/2005 Conrad
2005/0132680 A1 6/2005 Wegelin et al.
2005/0193516 A1 9/2005 Hughes
2006/0000052 A1 1/2006 Budd
2006/0123590 A1 6/2006 Fester et al.
2007/0061040 A1 3/2007 Augenbraun et al.
2007/0245511 A1 10/2007 Hahm et al.
2007/0251050 A1 11/2007 Harsh et al.
2008/0040876 A1 2/2008 Aiyar
2008/0235899 A1 10/2008 Haan
2008/0276407 A1 11/2008 Schnittman et al.
2009/0100636 A1 4/2009 Sohn et al.
2010/0024155 A1 * 2/2010 Policicchio ..... A47L 9/0686 15/347
2010/0024156 A1 * 2/2010 De Soto-Burt ..... A47L 5/28 15/347
2010/0024157 A1 * 2/2010 Vernon ..... A47L 9/0686 15/403
2010/0115719 A1 5/2010 West et al.
2010/0251497 A1 10/2010 Arnold
2010/0306939 A1 12/2010 Dingert
2011/0088209 A1 * 4/2011 Ivarsson ..... A47L 9/0686 15/393
2012/0110775 A1 5/2012 Krebs
2012/0159728 A1 6/2012 Suda et al.
2012/0311813 A1 12/2012 Gilbert, Jr. et al.
2013/0055521 A1 3/2013 Lee et al.
2013/0291333 A1 * 11/2013 Grey ..... A47L 9/122 15/347
2014/0033470 A1 2/2014 Codling
2014/0033471 A1 2/2014 Toole et al.
2015/0101617 A1 4/2015 Duffy
2015/0128364 A1 5/2015 Dooley et al.
2015/0223662 A1 8/2015 Doherty-Stapp et al.
2015/0250368 A1 9/2015 Kim et al.
2016/0100735 A1 4/2016 Milanese et al.
2016/0174793 A1 6/2016 Burke et al.
2016/0278594 A1 9/2016 Bradbury
2016/0353963 A1 12/2016 Kellis et al.
2017/0007086 A1 1/2017 Kleine-Doepke et al.
2017/0119223 A1 5/2017 Staf
2017/0202421 A1 7/2017 Hwang et al.
2018/0014711 A1 1/2018 Rostami
2018/0035855 A1 2/2018 Wood
2018/0055315 A1 3/2018 Conrad
2018/0177367 A1 6/2018 Amaral et al.
2018/0220861 A1 8/2018 Zhang et al.
2019/0075984 A1 * 3/2019 James ..... A47L 9/0673
2019/0269289 A1 9/2019 Xu et al.
2019/0274496 A1 9/2019 James et al.
2019/0274497 A1 9/2019 James et al.
2019/0274498 A1 9/2019 James et al.
2019/0274500 A1 * 9/2019 Thorne ..... A47L 5/24
2019/0282045 A1 9/2019 James et al.
2020/0138256 A1 * 5/2020 Douglas ..... A47L 5/28

FOREIGN PATENT DOCUMENTS

CN 101061929 A 10/2007
CN 102112030 A 6/2011
CN 102961085 A 3/2013
CN 103356140 A 10/2013
CN 205181229 U 4/2016
CN 107028564 A 8/2017
CN 209595637 U 11/2019
DE 667452 C 11/1938
EP 1027844 A2 8/2000
EP 1219222 A1 7/2002
EP 1525839 A2 4/2005
GB 2161902 A * 1/1986 ..... A47L 5/24
JP 2003326121 A 11/2003
JP 2006198083 A 8/2006
JP 2006198083 A * 8/2006
JP 2008206944 A 9/2008
JP 2008228768 A 10/2008
JP D1489801 S 2/2014
JP 2014200435 A 10/2014
KR 1020060112749 A 11/2006

(56) References Cited

FOREIGN PATENT DOCUMENTS

| | | | |
|---|---|---|---|
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2010014366 | A1 | 2/2010 |
| WO | 2010014367 | A1 | 2/2010 |
| WO | 2011017493 | A1 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2017144918 | A1 | 8/2017 |
| WO | 2019051431 | A1 | 3/2019 |

OTHER PUBLICATIONS

U.S. Appl. No. 16/670,103, filed Oct. 31, 2019, Replacement Head for a Vacuum.
U.S. Appl. No. 16/670,039, filed Oct. 31, 2019, Replacement Head for a Vacuum.
U.S. Appl. No. 16/670,476, filed Oct. 31, 2019, Comet, Replacement Head Filter.
U.S. Appl. No. 16/126,549, filed Sep. 10, 2018, Cleaning Device.
U.S. Appl. No. 16/420,453, filed May 23, 2019, Cleaning Device.
U.S. Appl. No. 16/420,475, filed May 23, 2019, Cleaning Device.
U.S. Appl. No. 16/420,498, filed May 23, 2019, Cleaning Device.
U.S. Appl. No. 16/429,306, filed Jun. 3, 2019, Cleaning Device.
U.S. Appl. No. 16/896,762, filed Jun. 9, 2020, Cleaning Device.
U.S. Appl. No. 17/038,975, filed Sep. 30, 2020, Cleaning Device.
U.S. Appl. No. 17/039,057, filed Sep. 30, 2020, Cleaning Device.
U.S. Appl. No. 17/039,103, filed Sep. 30, 2020, Cleaning Device.
U.S. Appl. No. 17/039,155, filed Sep. 30, 2020, Cleaning Device.
U.S. Appl. No. 17/039,814, filed Sep. 30, 2020, Cleaning Device.
U.S. Appl. No. 17/039,725, filed Sep. 30, 2020, Cleaning Device.
U.S. Appl. No. 17/062,432, filed Oct. 2, 2020, Cleaning Device.
U.S. Appl. No. 17/062,455, filed Oct. 2, 2020, Cleaning Device.
U.S. Appl. No. 17/062,489, filed Oct. 2, 2020, Cleaning Device.
U.S. Appl. No. 17/062,540, filed Oct. 2, 2020, Cleaning Device.
U.S. Appl. No. 17/067,537, filed Oct. 9, 2020, Cleaning Device.
U.S. Appl. No. 17/089,555, filed Nov. 4, 2020, Cleaning Device.
U.S. Appl. No. 16/671,220, filed Nov. 1, 2019, Cleaning Device.
U.S. Appl. No. 17/089,575, filed Nov. 4, 2020, Cleaning Device.
U.S. Appl. No. 16/718,725, filed Dec. 18, 2019, Cleaning Device.
U.S. Appl. No. 17/039,137, filed Sep. 30, 2020, Cleaning Device.
U.S. Appl. No. 17/091,983, filed Nov. 6, 2020, Cleaning Device.
U.S. Appl. No. 17/104,229, filed Nov. 25, 2020, Cleaning Device.
U.S. Appl. No. 17/091,945, filed Nov. 6, 2020, Cleaning Device.
U.S. Appl. No. 17/067,521, filed Oct. 9, 2020, Cleaning Device System and Method for Use.
U.S. Appl. No. 17/089,532, filed Nov. 4, 2020, Cleaning Device System and Method for Use.
U.S. Appl. No. 16/795,012, filed Feb. 19, 2020, Cleaning Device System and Method for Use.
Amazon.com—Shark Genius Steam Pocket Mop Hard Floor Cleaner, oldest reviews 2016, https://www.amazon.com/Cleaner-Blaster-Technology-Intelligent-S5003D/dp/B01 KU4BSGK/ref=cm_cr arp_d_product_top?ie=UTF8, site visited Oct. 11, 2018.
International Search Report; Application No. PCT/US2018/050308; dated Nov. 26, 2018; 3 pages.
Extended European Search Report received for EP Application No. 18854457.1, dated Apr. 2, 2020, 5 pages.
Extended European Search Report received for EP Application No. 19215569.5, dated May 15, 2020, 5 pages.
International Preliminary Report on Patentability received for PCT Application No. PCT/US2018/050308, dated Mar. 26, 2020, 13 pages.
International Search Report and Written Opinion received for PCT Application No. PCT/US2019/059327, dated Feb. 6, 2020, 10 pages.
International Search Report and Written Opinion received for PCT Application No. PCT/US2019/067121, dated May 7, 2020, 12 pages.
International Search Report and Written Opinion received for PCT Application No. PCT/US2020/058146, dated Feb. 2, 2021, 13 pages.
International Search Report and Written Opinion received for PCT Application No. PCT/US2020/058162, dated Feb. 2, 2021, 12 pages.
International Search Report and Written Opinion received for PCT Application No. PCT/US2020/059491, dated Feb. 2, 2021, 9 pages.
International Search Report and Written Opinion received for PCT Application No. PCT/US2020/059503, dated Feb. 3, 2021, 7 pages.
International Search Report and Written Opinion received in PCT Application No. PCT/US2020/058195, dated Dec. 21, 2020, 13 pages.
Invitation to Pay Additional Fees received for PCT Application No. PCT/US2020/062158, dated Jan. 11, 2021, 2 pages.
(Aug. 1, 2019) N.K. Multi-Tech Filters Pvt. Limited, Available at: https://www.airfiltersindia.net/product_temp_No_Upload.html, 4 Pages.
Extended European Search Report issued in European Application No. 21212780.7, dated Apr. 4, 2022, 5 pages.

* cited by examiner

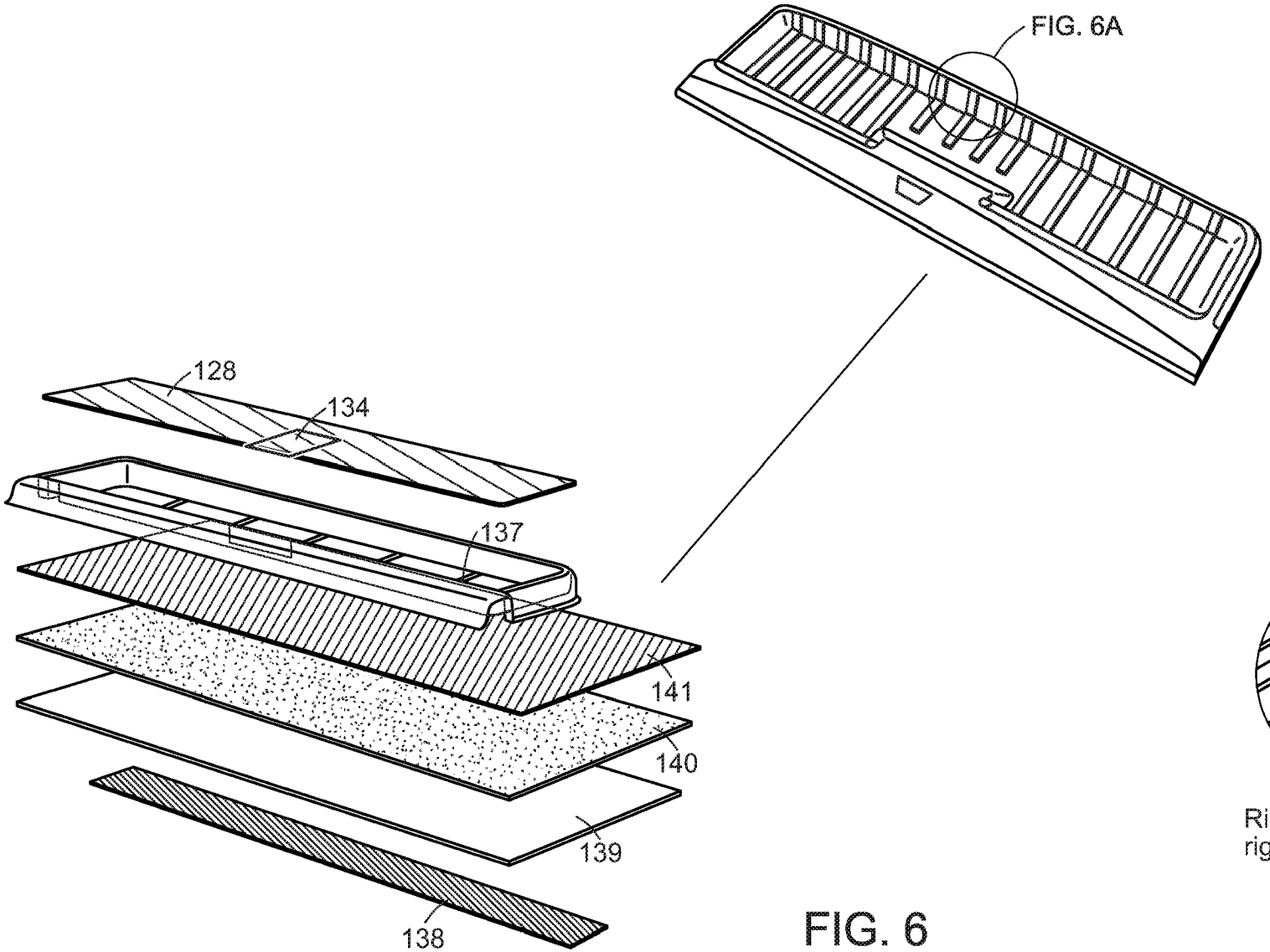
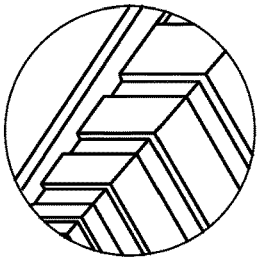
Rib details give rigidity and strength
FIG. 6A
FIG. 6

CLEANING DEVICE

CROSS-REFERENCE TO RELATED APPLICATION

This application claims priority of provisional patent application U.S. 62/781,436 filed on Dec. 18, 2018, the specification of which is hereby incorporated by reference.

FIELD OF THE INVENTION

Embodiments disclosed herein related generally to cleaning devices, and more specifically to vacuums and cleaning heads for vacuums.

BACKGROUND OF THE INVENTION

Cleaning devices are used in the home and office to clean floors and other surfaces. Various types of cleaning devices are known, such as vacuums with disposable bags, and vacuums with dirt bins that can be emptied and re-used.

SUMMARY OF THE INVENTION

According to one embodiment, an apparatus includes a debris collection chamber, an air filter configured to allow air to pass through the air filter while inhibiting debris from passing through the air filter, and a collection chamber inlet opening configured to allow debris-entrained air to flow into the collection chamber. The air filter includes an elongated strip that is movable from a first sealed position, in which the elongated strip covers the chamber inlet opening, to a second unsealed position in which the elongated strip does not cover the chamber inlet opening.

According to another embodiment, an apparatus adapted to be attached to a vacuum cleaner includes a debris collection chamber and a collection chamber inlet opening configured to allow debris-entrained air to flow into the debris collection chamber. The apparatus also includes an air filter configured to allow air to pass through the air filter while inhibiting debris from passing through the air filter. An internal valve is provided which is movable from a first position in which the internal valve covers the chamber inlet opening, to a second position in which the internal valve does not cover the chamber inlet opening. The internal valve is attached to the air filter, and the air filter is arranged such that when the air filter is under no negative pressure, the internal valve is in the first position. The internal valve is also arranged such that when negative pressure is applied to the air filter to draw air through the chamber inlet opening, the air filter moves the internal valve to the second position.

According to yet another embodiment, an apparatus adapted to be attached to a cleaning device having a suction source is provided. The apparatus includes a debris collection chamber and a collection chamber inlet opening configured to allow air to flow into the debris collection chamber when negative pressure is applied to the debris collection chamber. The apparatus also includes an internal valve movable from a first position, in which the internal valve covers the chamber inlet opening, to a second position in which the internal valve does not cover the chamber inlet opening. The internal valve includes multiple layers. At least a first layer of the multiple layers is configured to selectively move the internal valve from the first position to the second position at a pleat formed in the first layer.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 6 is an exploded view of the cleaning head and sheet assembly;

DETAILED DESCRIPTION OF THE INVENTION

Figure 1:
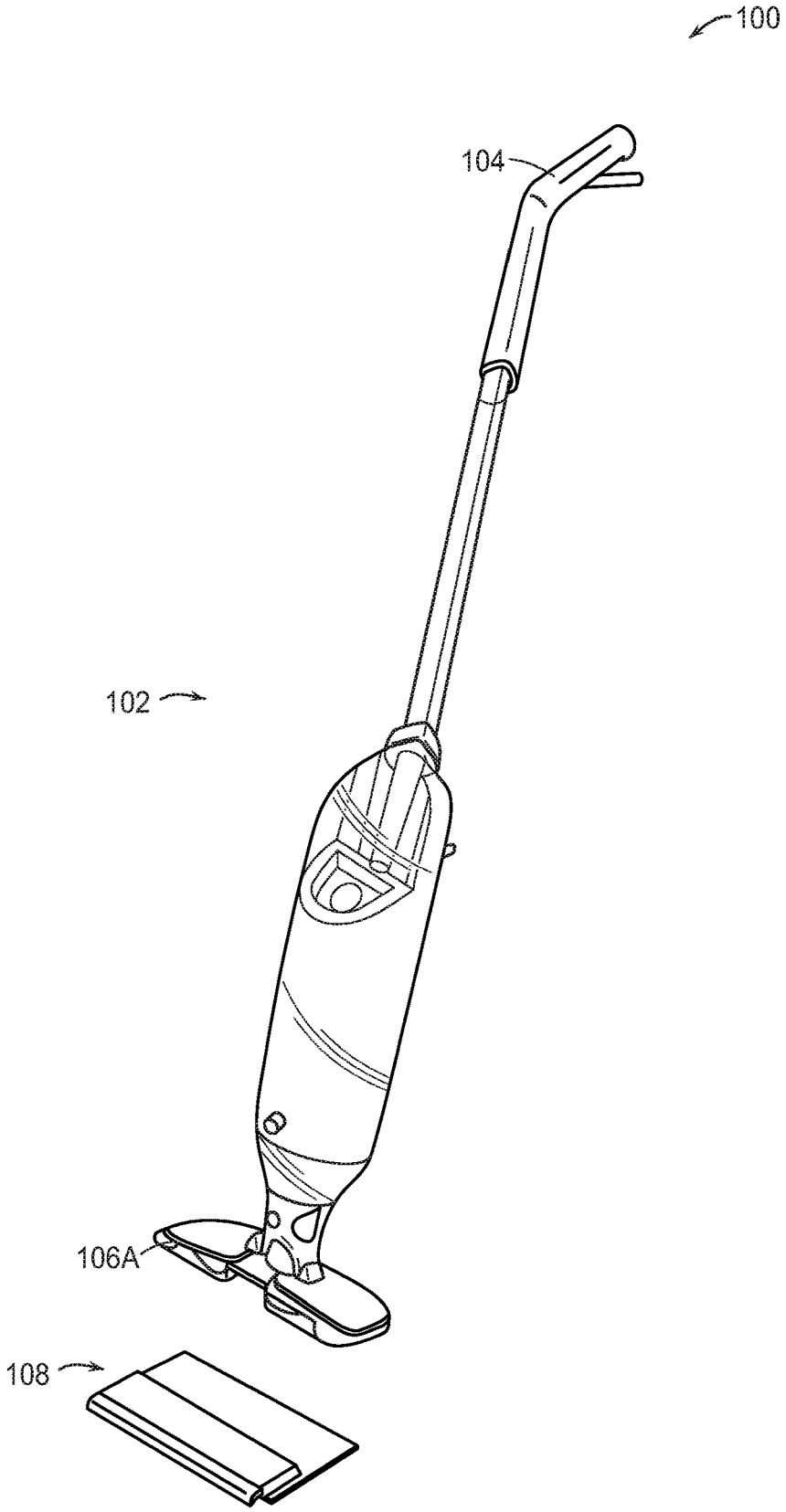
FIG. 1 is a perspective view of a cleaning device according to embodiments of the present disclosure.

Conventional bag vacuums typically require the user to remove a bag from a housing interior, dispose of the bag, and insert a new bag. Removing the bag can put dust in the air and/or result in spilled debris. Cyclonic vacuum cleaners often have a debris collection chamber that can be removed from the body of the vacuum, emptied, and reused.

For cleanup jobs that do not require a full-size vacuum cleaner, the inventors have appreciated that a debris collection container which remains closed upon removal from the vacuum can be helpful. Disclosed herein are debris collection chamber arrangements which allow debris-entrained air to enter a collection chamber through an inlet opening when the vacuum cleaner is turned on. The collection chamber arrangements cover the inlet opening when the vacuum cleaner is turned off, which limits undesirable release of debris from the collection chamber. In some embodiments, the collection chamber is disposable, and in some embodiments, the collection chamber is attached to a cleaning head, and the entire cleaning head is disposable.

To facilitate covering the collection chamber inlet opening, a cover for the inlet opening may be arranged to move in response to the presence of negative pressure in the vacuum cleaner. For example, a planar piece of filter material may cover the inlet opening when the vacuum cleaner is off. When the vacuum cleaner is turned on and negative pressure is applied to the filter material, the filter material pulls away from the inlet opening, thereby allowing air and debris to enter the collection chamber. The inflow of air substantially prevents dirt from exiting the collection chamber through the inlet opening. When the vacuum cleaners turned off, the filter material returns to its position covering the inlet opening. Such an arrangement provides for covering the inlet opening without user intervention.

In some embodiments, the filter material is attached to the debris collection chamber with an elastic connector. The elastic connector allows the filter material to be pulled away from the inlet opening when the filter material is subjected to a negative pressure by a suction source. In other embodiments, no elastic connection is provided, and the inherent flexibility of the filter material allows the filter material to move away from the inlet opening.

In some embodiments, the cover for the inlet opening is not filter material. For example, a piece of filter material may form substantially the entire top wall of a collection chamber, but include an air impermeable portion which covers and uncovers the inlet opening. In still other embodiments, an entire top wall of the collection chamber may be formed of a flexible material other than an air filter. The top wall may move to cover and uncover the inlet opening, while a separate portion of the collection chamber has an air outlet that applies a negative pressure to the collection chamber.

By automatically closing the chamber inlet opening when the vacuum cleaner is turned off, the collection chamber may be completely enclosed to limit release of debris. The arrangement can also be helpful to limit spillage or egress of collected debris from the collection chamber when the user removes and/or transports the collection chamber for debris disposal. In some embodiments, the collection chamber may be adapted for reuse and include an aperture which is selectively openable to discard debris from the chamber. In other embodiments, the collection chamber may be adapted to be disposed of once the chamber is full. For example, in some embodiments the collection chamber may have no openings other than the inlet opening. In some embodiments, the collection chamber is not openable by a user to dispose of debris from the debris collection chamber without damaging the debris collection chamber. The collection chamber may be permanently attached to, and form at least a portion of, a disposable cleaning head in some embodiments, such that the entire head is disposed of after use.

For purposes herein, debris being suctioned into the debris collection chamber may include dry and/or wet media. For example, in some embodiments, a liquid applied to the surface may be absorbed by a cleaning sheet and/or suctioned by the vacuum into the debris collection chamber. In some embodiments, the wet media may be absorbed by at least a portion of the material used to form the debris collection chamber. In some embodiments, the debris collection chamber may be formed of a material which allows for fluid absorption into the material but does not allow for liquid transfer through the material. In such embodiments, liquid may not travel through the debris collection chamber. For example, the material used to form the debris collection chamber may be absorptive on an inner side of the debris collection chamber, but liquid impermeable.

Advantages also may be realized if the user does not have to handle the wet or dirty cleaning head after operation of the cleaning device. For example, the cleaning device may be arranged to release the cleaning head after using the cleaning device such that the user does not have to grasp the cleaning head to discard it. With a permanently attached debris collection chamber, and a release arrangement that does not require the user to touch the cleaning head, the cleaning head can be disposed of with limited or no user contact.

In some embodiments, the cleaning head includes a support structure to which the debris collection chamber is attached. In such embodiments, the user may simply attach the cleaning head to the cleaning device, operate the cleaning device to move dirt from the surface and into the debris collection chamber, remove the cleaning head, and dispose of the cleaning head in a trash receptacle.

In some embodiments, the cleaning heads are arranged for space-efficient stacking for ease of storage and transport. In some embodiments, the dirt collection chambers are arranged to be collapsible. For example, the dirt collection chamber may include a bag.

FIG. 1 shows a cleaning device 100 according to some embodiments of the present disclosure. The cleaning device 100 includes a body 102 with a handle 104, a first connector 106A, and a cleaning head 108 which is removably attachable to the body at a second connector 106B, such as via the first connector 106A. In some embodiments, the handle may have a length that is adjustable to allow a user to adjust the height of the cleaning device.

Figure 2:
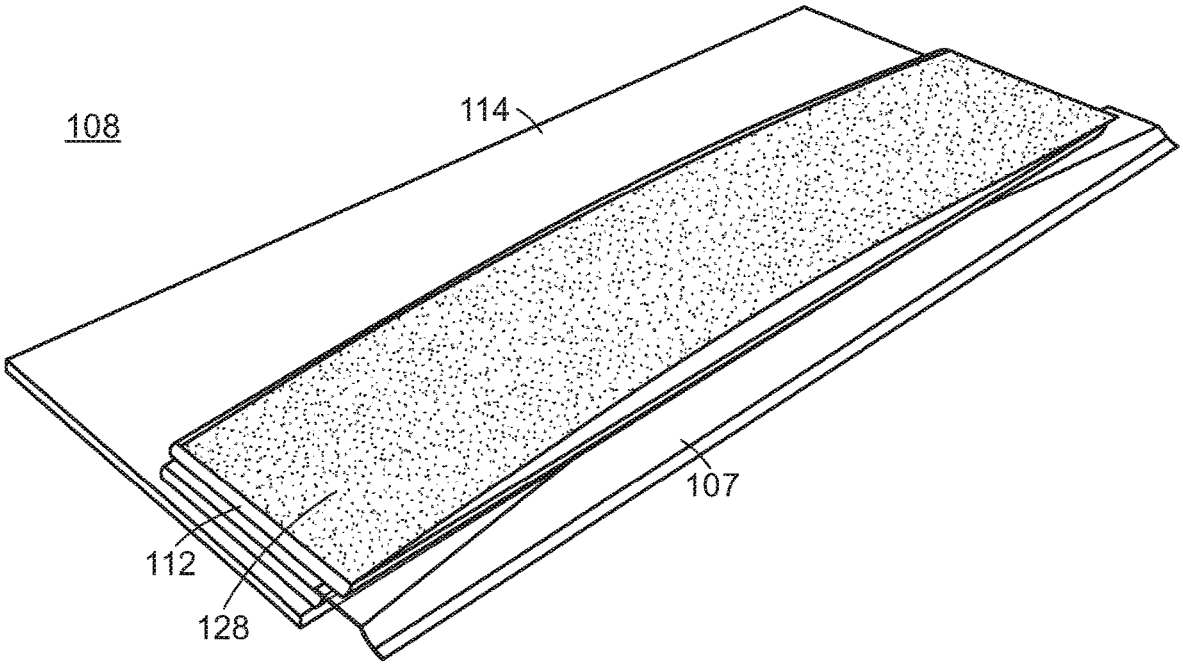
FIG. 2 is a top, front perspective view of a cleaning head according to some embodiments.
Figure 2:
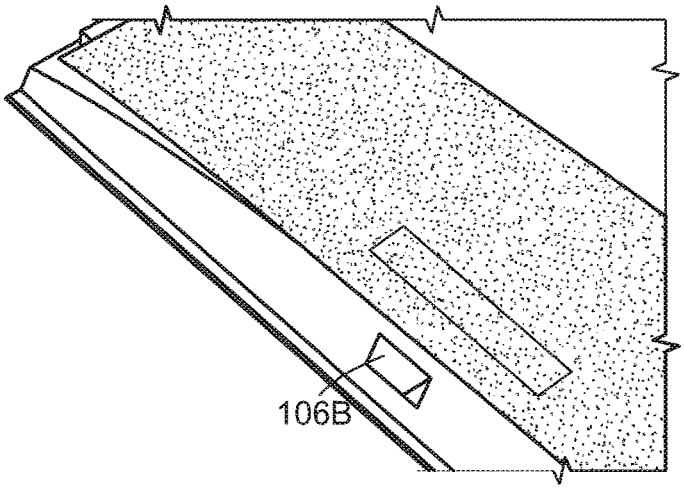
Figure 3:
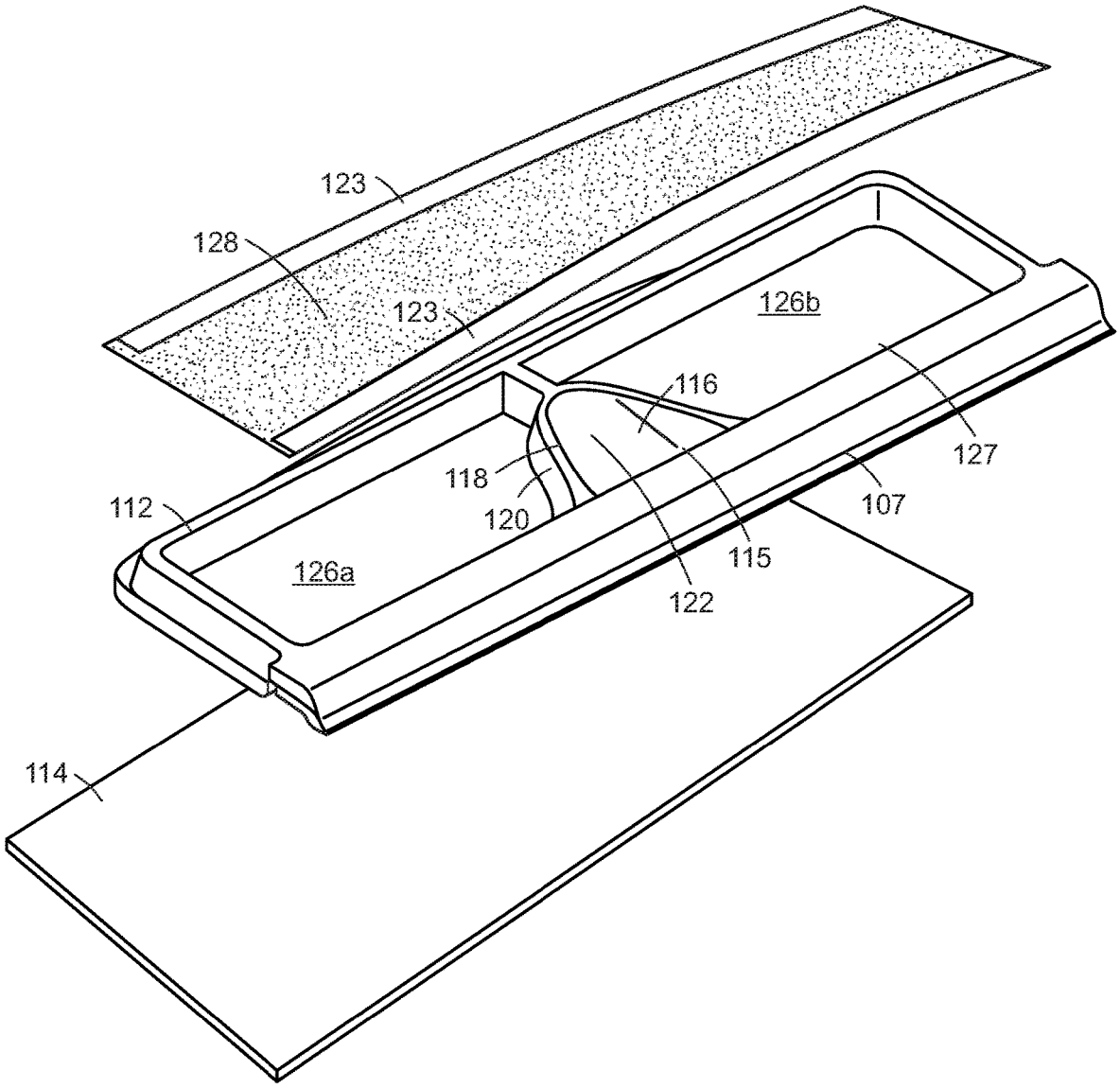
FIG. 3 is an exploded view of the cleaning head of FIG. 2.
Figure 4:
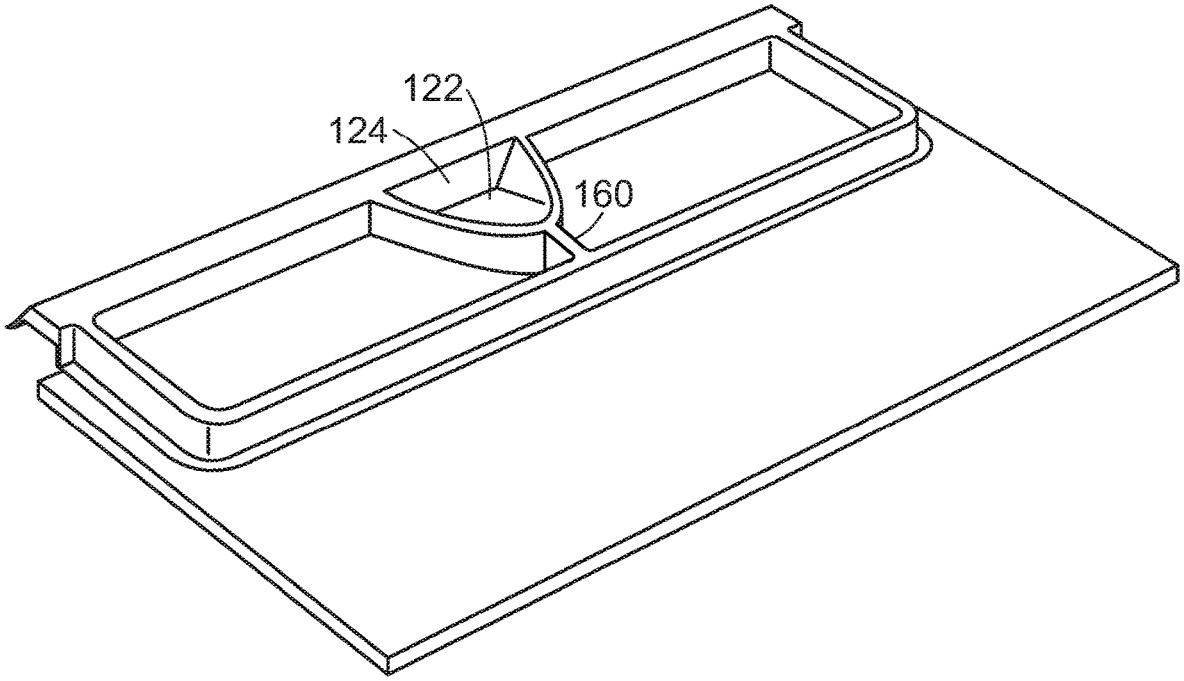
FIG. 4 is a top, rear perspective view of the cleaning head of FIG. 2 with the filter removed.

As shown in FIGS. 2-4, the cleaning head 108 may include a suction nozzle 107 to remove debris from a surface, and a debris collection chamber 112 to collect the debris removed from the surface. As will be appreciated, the debris collection chamber 112 may be any suitable type of container for collecting debris such as dirt, dust, food, or wet media. In some embodiments, the debris collection chamber 112 may be permanently or removably attached to a cleaning sheet 114. For example, the collection chamber 112 may be glued, heat sealed, or otherwise permanently affixed to cleaning sheet 114.

In some embodiments, an additional support structure may be provided. For example, a substantially planar support frame may be provided between the collection chamber 112 and the cleaning sheet 114, although the support structure may have other suitable arrangements.

In some embodiments, the collection chamber 112 protrudes upwardly from the cleaning sheet 114 or support structure. For purposes herein, the term "protruding upwardly" means that the collection chamber 112 protrudes away from the support structure in a direction away from the surface being cleaned.

The collection chamber 112 includes an inlet 115 having an inlet opening 116, which in the illustrated embodiment, is located at a top portion of the collection chamber 112. The inlet opening 116 is formed by a top rim 118 of an upwardly extending wall 120. The inlet 115 may have a ramp 122 extending from a suction inlet 124 into the collection chamber 112 to aid in moving debris from the suction inlet 124 into collection areas 126*a*, 126*b* of the collection chamber 112. Though in some embodiments the area below the inlet opening 116 may have a floor that is coplanar with a bottom 127 of the collection areas 126*a*, 126*b* of the collection chamber 112.

Figure 5:
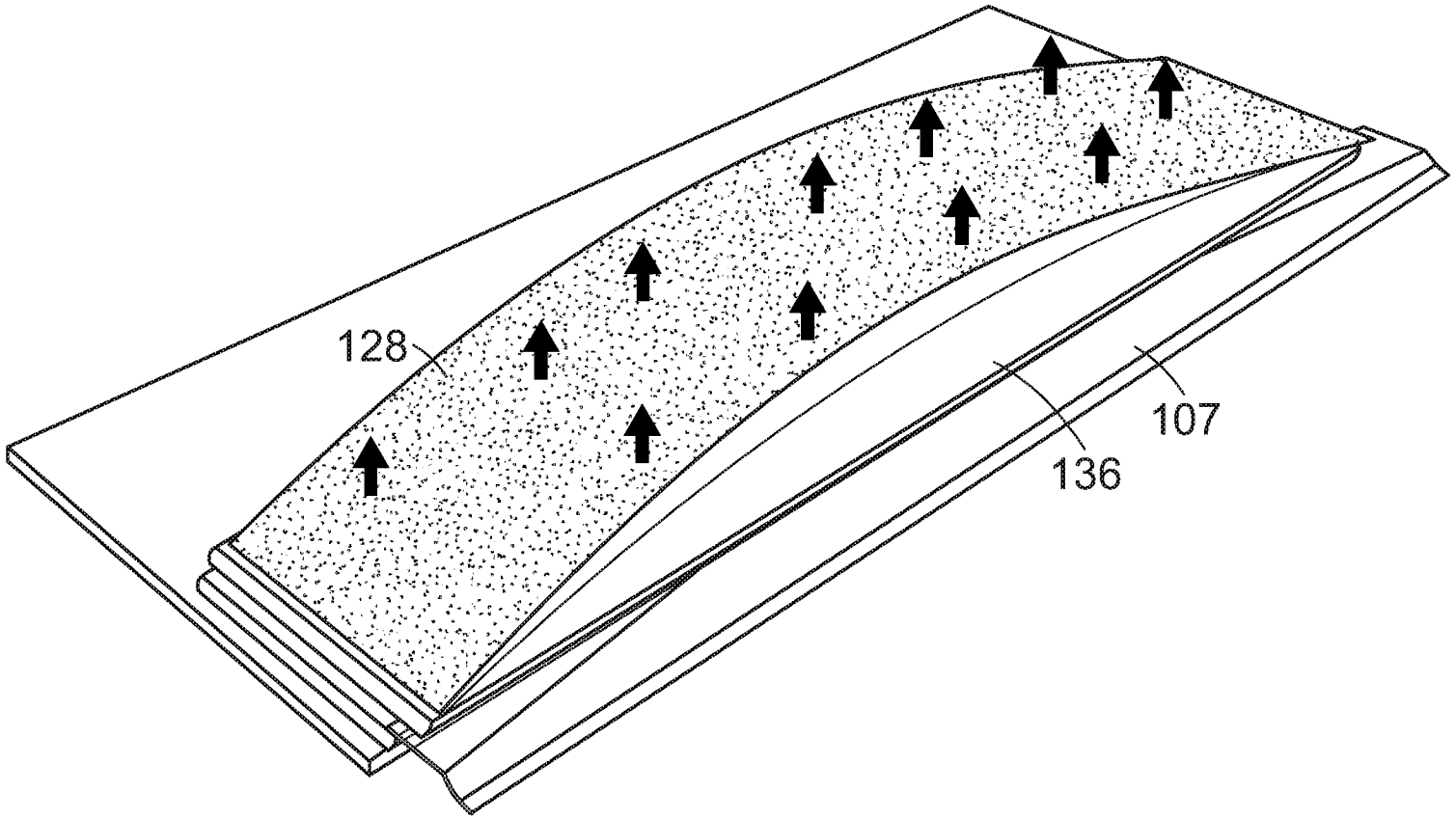
FIG. 5 shows the cleaning head of FIG. 2 in a state where negative pressure is being applied to the collection chamber.

An air filter 128 forms a top wall of the collection chamber 112 in some embodiments. The filter material may be attached to the collection chamber 112 such that in a first position, as shown in FIG. 2, the air filter 128 covers inlet opening 116. In this position, the air filter 128 inhibits debris that has already been collected in collection areas 126*a*, 126*b* from moving over wall 120 and through the inlet opening 116. The air filter 128 and the collection chamber 112 are arranged such that the air filter 128 is in this first position when negative pressure is not being applied to the air filter 128. When negative pressure is applied to the air filter 128, the air filter 128 moves upwardly (see FIG. 5) and separates from the inlet opening 116. In this second position, debris-entrained air can flow through suction inlet 124, up and over wall 120, and into the debris collection areas 126*a*, 126*b*. As mentioned above, the air filter 128 may be attached to the collection chamber 112 with an elastic connection. For example, as shown in FIG. 5, an elongated strip 136 of elastic material connects the air filter 128 to a top portion of the collection chamber 112 along a front wall of the collection chamber 112. A similar elongated elastic strip (not visible in FIG. 5) connects the air filter 128 to the top portion of the collection chamber 112 along the rear wall of the collection chamber. The stretchability of the elongated strips 136 allows the air filter 128 to move away from the inlet opening 116. In some embodiments, elastic connectors may be used on one or both walls at the lateral sides of the collection chamber 112.

In some embodiments, only a portion of the air filter 128 may rise from the collection chamber 112 when negative pressure is applied to the cleaning head 108. For example, elastic connectors may be provided along only certain portions of the air filter 128. The elastic portions may be provided in an area of the air inlet opening 116 such that the air filter 128 lifts only in the area at or near the air inlet opening 116, while the remaining areas of the air filter 128 are not substantially lifted.

In still further embodiments, the air filter 128 may be connected to the collection chamber without any elastic connectors such that the air filter 128 does not move at the connection points. In such an embodiment, the air filter 128 may have a size and shape which allows the air filter 128 to sufficiently lift away from the air inlet opening 116 when under negative pressure such that the cover lifts away from the air inlet opening 116. For example, adhesive strips 123 may be provided on the filter material 128, to secure the filter material to the collection chamber 112, as shown by way of example in FIG. 3.

Materials other than an air filter 128 may be used to cover the inlet opening 116 in some embodiments. For example, as shown in FIG. 6, a section of air impermeable material may be used in the area of the top wall of the collection chamber 112 as a cover 134 for the inlet opening 116. Cover 134 may have the same shape as a perimeter of the chamber inlet opening 116, or it may have a different shape. In some embodiments, an underside of cover 134 may be provided with an additional material layer. For example, a layer of material which conforms easily to rim 118 may be adhered to an underside of the air filter. Such a layer may act to seal the inlet opening against passage of debris.

The portions of the top wall outside of the cover 134 are shown as air filter 128 in the embodiment of FIG. 6, but other materials may be used to form the top wall of the collection chamber 112. In some embodiments, the entire top wall may be air impermeable, and one or more air filters may be provided elsewhere in the arrangement, as discuss below with reference to FIG. 7D.

The collection chamber 112 may include stiffening ridges 137 along a bottom of the collection chamber 112. The stiffening ridges 137 may allow for less material to be used in forming the collection chamber 112. The stiffening ridges 137 are shown traveling from front to back in the collection chamber, however, stiffening ridges may be positioned and sized in any suitable manner. Stiffening ribs or grooves may be used instead of, or in addition to, stiffening ridges and may allow for material to be used in forming the collection chamber 112 compared to the stiffening ridges 137. In some embodiments, the collection chamber 112 is formed with a plastic thermoforming process. The collection chamber 112 may be manufactured using any suitable process. For example, the collection chamber 112 may be injection molded or compression molded. In some embodiments, the collection chamber 112, the suction nozzle 107, and the suction inlet 115 may be a unitary piece. In some embodiments, the collection chamber 112, the suction nozzle 107, and the inlet 115 may be integrally formed, such as by thermoforming. In other embodiments, one more of the collection chamber 112, the suction nozzle 107, and the suction inlet 115 may be separately formed and attached.

As mentioned above, a cleaning sheet 114 may be attached to the collection chamber 112. The cleaning sheet 114 may be formed of any suitable material, and may be made of a single layer or multiple layers. In the illustrated embodiment, the cleaning sheet 114 includes multiple layers including a multifunctional strip 138, a face layer 139, and first and second absorbent layers 140 and 141. The face layer 139 and absorbent layers 140, 141 may be made from various non-woven materials, woven materials, and/or plastics, or any other suitable materials. The absorbent layers 140, 141 may be configured to wick moisture away from the face layer 139. The multifunctional strip 138 may be used for scrubbing in some embodiments. In some embodiments, the multifunctional strip 138 may provide friction to help prevent the cleaning device 100 from slipping when propped against a wall.

In some embodiments, the air filter material may be limited to specific sections of the collection chamber. For example, a top chamber wall similarly arranged to the air filter 128 shown in FIG. 6 may have air permeable sections only at or near lateral ends of the top chamber wall, and have air impermeable material in the remaining section. In other embodiments, air permeable sections may be positioned close to a centered inlet opening on both sides of the inlet opening 116. In still other embodiments, a collection chamber 112 may include more than one inlet opening 116 and a cover for each of the openings.

A cover may include portions which extend downwardly into the inlet opening 116 and/or around the outside of the chamber inlet opening 116. For example, a collar may be attached to an underside of the air filter 128 such that when the vacuum is turned off and the air filter 128 returns to a home position, the collar covers some or all of the perimeter of the inlet opening 116.

Figure 7A:
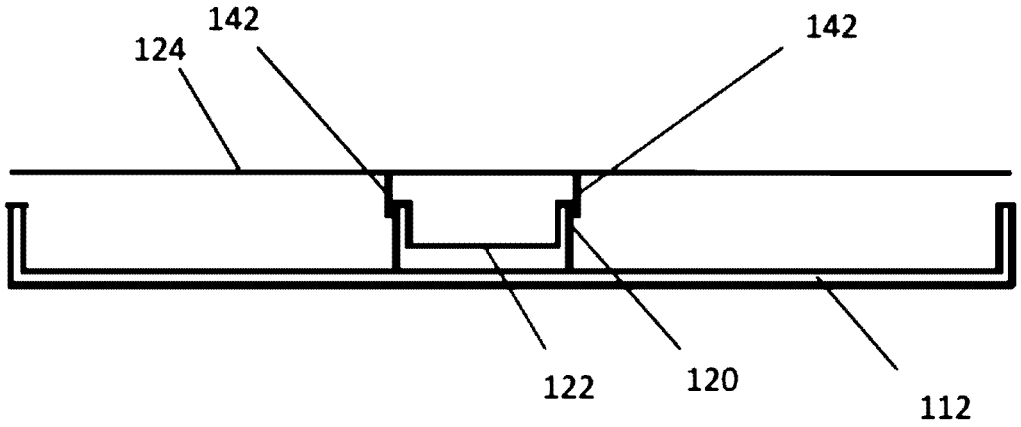
FIG. 7A is a cross-sectional front view of a cleaning head and a partially lifted top chamber wall according to some embodiments.

In some embodiments, a collar 142 is connected to an underside of air filter 124, as shown in FIG. 7A. When the air filter 124 is moved to a home position, the collar 142 is positioned next to, or in contact with, an outside of wall 120.

The air filter 124 is shown slightly higher than a home position in FIG. 7A. The collar 142 may be made of a rigid material or may be made of a flexible material.

Figure 7B:
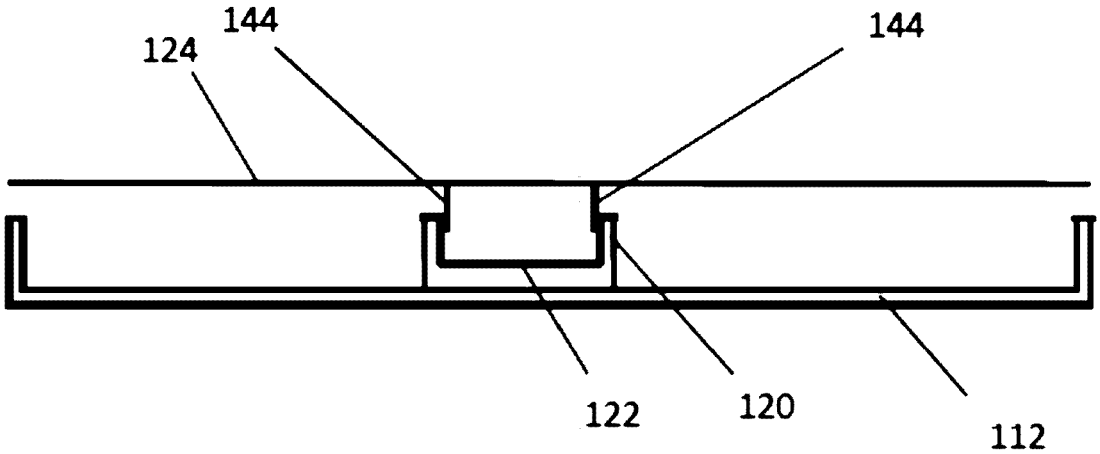
FIG. 7B is a cross-sectional front view of a cleaning head and a partially lifted top chamber wall according to alternative embodiments.

Referring to FIG. 7B, a downwardly extending member is positioned inside the inlet opening 116 when the air filter 124 is in the home position. A collar 144 is adapted to be positioned next or in contact with an inside of wall 120. As with the embodiment illustrated in FIG. 7A, the collar 144 may be made of a rigid material or a flexible material. The downwardly extending cover structures shown in FIGS. 7A and 7B may be used in addition to or instead of a substantially horizontal cover portion of the air filter 124.

Figure 7C:
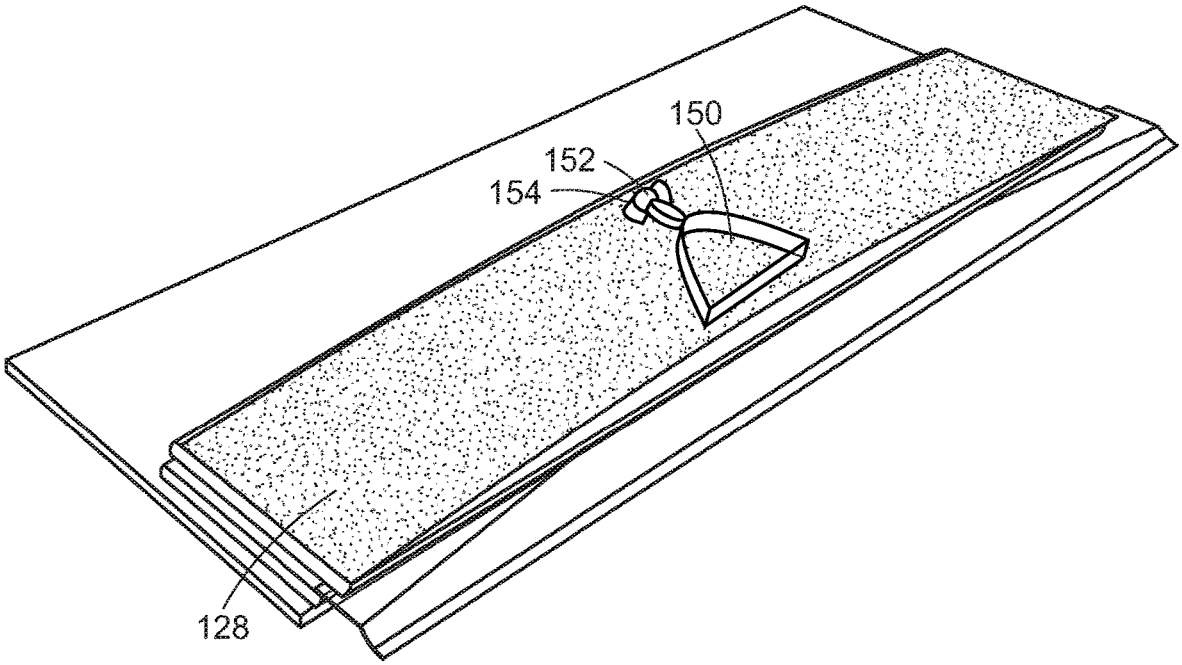
FIG. 7C shows a cover stabilizer according to some embodiments.

A cover stabilizer may be implemented to help maintain contact between the cover and a rim of the inlet opening 116. For example, as shown in FIG. 7C, a cover stabilizer 150 has a similar shape to the rim 118 of the outlet opening shown in FIGS. 3 and 4. Stabilizer 150 is pivotally attached to the air filter 124, 128 at a pivot joint 152, and is biased downwardly by a torsion spring 154. In other embodiments, the stabilizer may be formed with or otherwise attached to the connector 106A. The force applied by the stabilizer 150 may press the underside of air filter 124, 128 to secure contact with the rim 118 of the air inlet opening. The weight of the stabilizer 150 and the strength of the torsion spring 154 may be configured such that when the air filter 124, 128 is lifted from the collection chamber 112, the stabilizer 150 does not overly deforms the shape of the air filter 124, 128. In some embodiments, a mechanical limit to the rotation of the stabilizer 150 may be implemented, for example at the pivot joint 152.

A conduit end does not have to be fully exposed to be considered to be an inlet opening 116 that is not covered by a cover. For example, if the air inlet opening 116 for a debris collection chamber 112 is formed by an upright cylindrical column with a top circular rim, and an air filter 128 is removed from a sufficient portion of the circular rim during vacuuming to permit flow of air and debris into the collection chamber 112, the air inlet opening 116 may be considered to be not covered by the air inlet opening cover.

Figure 7D:
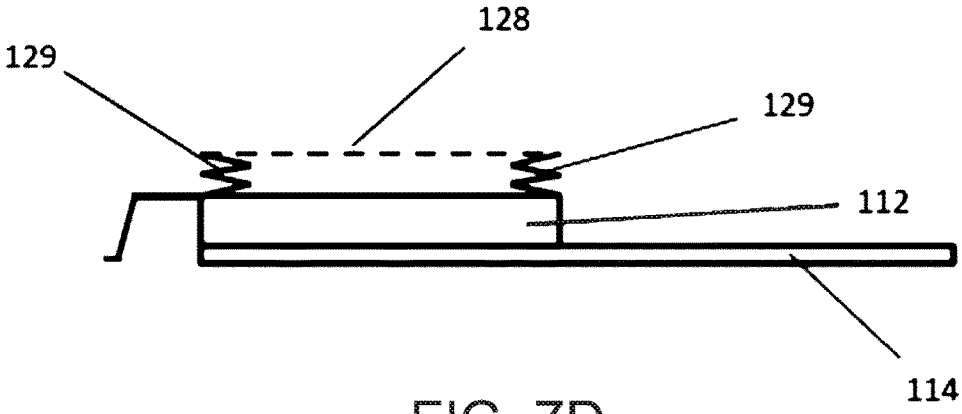
FIG. 7D is a cross-sectional side view of a cleaning head with a chamber inlet cover arrangement according to some embodiments.

As mentioned above, the air filter (or other collection chamber wall) 128 may be connected to the collection chamber 112 without any elastic connectors. FIG. 7D shows one embodiment where the air filter 128 is attached to the collection chamber with a pleated material 129. The air filter 128 is shown slightly lifted from the collection chamber in FIG. 7D. When negative pressure is applied to the air filter 128, the air filter 128 pulls on and unfolds the pleats. When the negative pressure is released, the pleats may be biased to return toward their folded position such that the air filter 128 covers the chamber inlet opening 116. In some embodiments, a cover stabilizer, such as the stabilizer 150 shown in FIG. 7C, may be used in conjunction with a pleated arrangement or other non-elastic arrangement.

Instead of, or in addition to, using air filter 128 as the top wall of the collection chamber 112, the pleated material 129 may be formed of an air filter material. For example, the top wall may be formed with an air impermeable material, and the vacuum cleaner may be configured to encompass at least the top wall and the pleated sides 129. When negative pressure is applied, the top wall is lifted upwardly, exposing the air filter material of the pleated sides 129. Air is then withdrawn from the collection chamber 112 via the pleated sides 129.

While the embodiments illustrated herein show the air filter 128 positioned such that the air filter 128 acts as a top wall of the collection chamber 112, the air filter 128 may be positioned elsewhere on the collection chamber 112 and still function as a removable cover for the chamber inlet opening 116. For example, instead of facing upwardly as shown in FIGS. 3 and 4, the chamber inlet opening 116 may face rearwardly, and the air filter 128 may be positioned at the back of the collection chamber 112. In the home position, the air filter 128 may be held against the chamber inlet opening 116, for example with elastic connectors, to cover the inlet opening 116. When negative pressure is applied, the air filter 128 be moved away from the chamber inlet opening 116.

In still other embodiments, more than one wall of the collection chamber 112 may move in response to negative pressure. A movable wall may be a flexible bag structure. A wall is not necessarily required to be planar or rigid. For example, an entire debris collection chamber 112 may be formed as a flexible bag attached to the chamber inlet opening 116. A portion of the bag may be positioned against the chamber inlet opening 116 when no negative pressure is applied, and then as the bag expands from the application of negative pressure, the portion of the bag covering the chamber inlet opening 116 moves away to allow debris-entrained air to enter the bag. As described herein, walls may be planar and/or rigid, and collection chambers 112 may have a combination of rigid and flexible walls.

Applying a negative pressure to a collection chamber 112 includes applying a negative pressure to the outside of an air permeable portion of the chamber 112 and/or applying a negative pressure to an opening in the collection chamber 112.

Figure 8A:
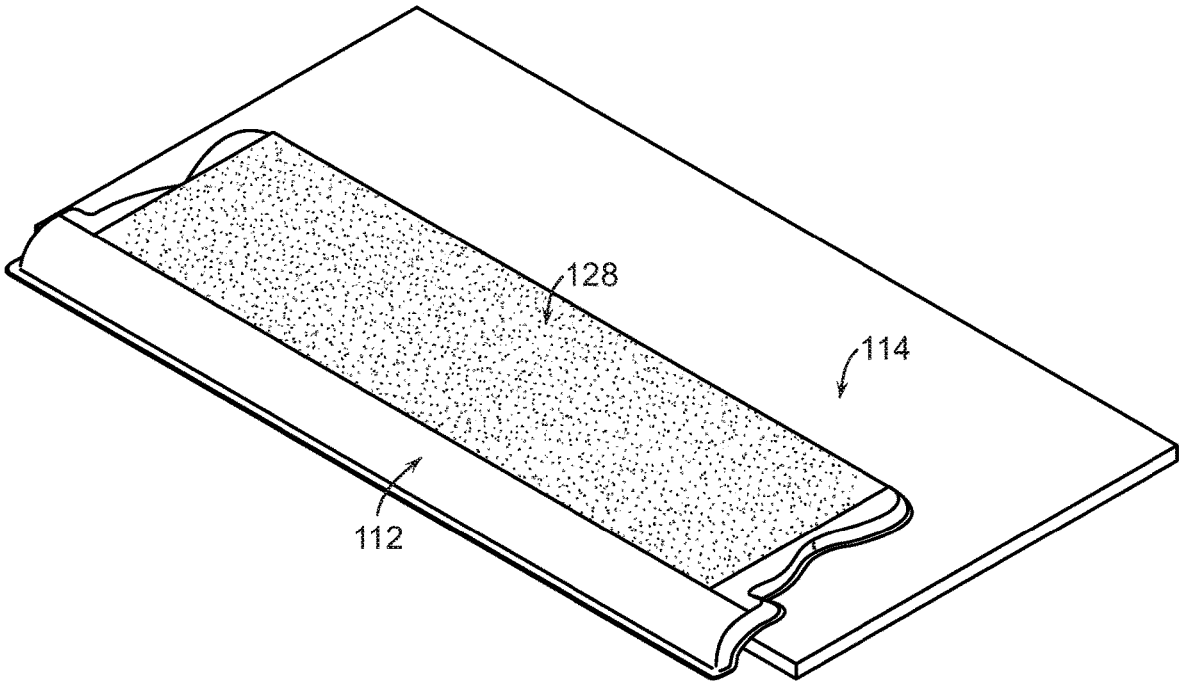
FIG. 8A is a top, front perspective view of a cleaning head according to some embodiments.
Figure 8B:
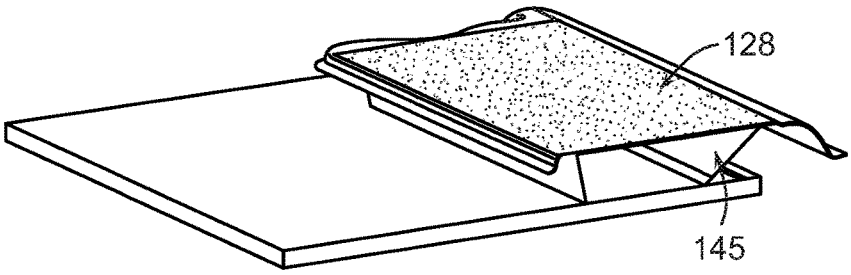
FIG. 8B is a cutaway view of the cleaning head of FIG. 8A.
Figure 8C:
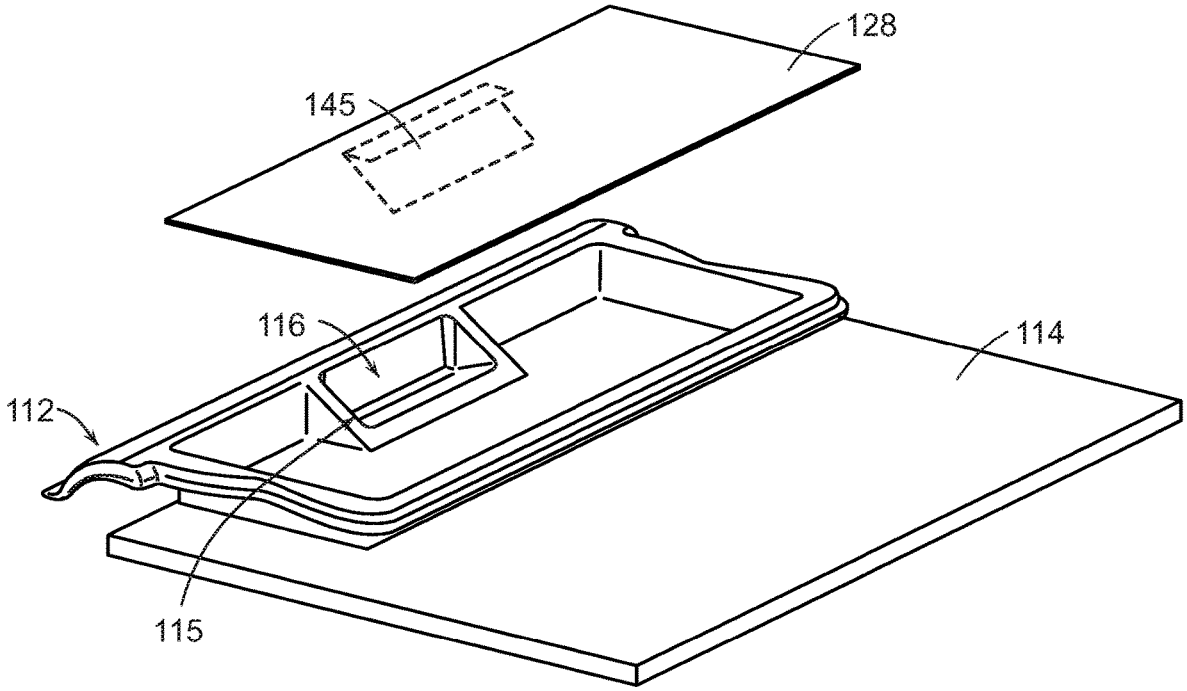
FIG. 8C is an exploded view of the cleaning head of FIG. 8A.
Figure 8C:
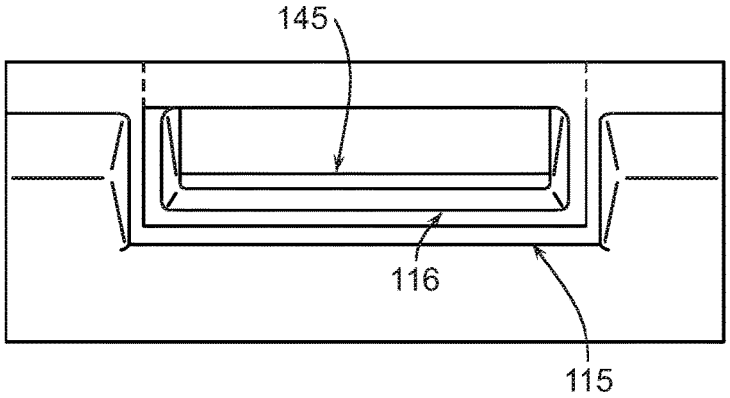

In some embodiments, such as those shown in FIGS. 8A-8C, the collection chamber 112 may include a lip and internal valve 145 that keeps dust, dry media, and/or wet media within the collection chamber 112 once the dirt has been moved into the chamber, thereby preventing dust and dry media from exiting via the chamber inlet opening 116 of the inlet 115, such as when the vacuum is powered off. In some embodiments, shown in FIGS. 8B and 8C, the internal valve 145 of the collection chamber 112 may be selectively openable and closeable at or near the chamber inlet opening 116. For example, the internal valve 145 may be pivotable between an open position 0 when the vacuum is turned on and a closed position C when the cleaning device 100 is turned off.

In some embodiments, shown in FIGS. 8B, 8C, and 9A-9D, the internal valve 145 may be integrally or attachably formed with at least a portion of the cleaning head 108. For example, the internal valve 145 may be integrally formed with or protrude from, for example, a top rim 118 of an upwardly extending wall 120 that forms a perimeter of the collection chamber 112. The internal valve 145 may protrude downwardly from the top rim 118 of the upwardly extending wall 120 to block or otherwise obscure the chamber inlet opening 116 when, for example, the vacuum is powered off. In other embodiments, the internal valve 145 may be attachably received at, for example, an elongated strip or other portion of the air filter 128. The elongated strip may be at least partially formed by the air filter 128 or be attachably received at the air filter and, in some embodiments, protrude downwardly from the air filter 128. For purposes herein, the term "protrudes downwardly" means that the internal valve 145 and/or elongated strip protrudes away from the air filter 128 in a direction toward the surface being cleaned.

Referring to FIGS. 9A-9D, in some embodiments, the internal valve 145 may be permanently or removably attached to the top rim 118 of the upwardly extending wall 120, the elongated strip, and/or at least a portion of the air filter 128. For example, the internal valve 145 may be glued, heat sealed, or otherwise permanently affixed to the top rim 118, the elongated strip, and/or the air filter 128. In some embodiments, the internal valve 145 may include or be formed of one or more flaps 146, 147, 148 (e.g., which one or more flaps may include the elongated strip or at least a portion of the air filter 128), which flaps 146, 147, 148 together aid in moving debris from the suction inlet 107 of the cleaning head 108 into collection areas 126*a*, 126*b* of the collection chamber 112 and inhibit debris that has already been collected in collection areas 126*a*, 126*b* from moving over wall 120 (see FIG. 3) and through the inlet opening 116 of inlet 115. The internal valve 145 and/or the one or more flaps 146, 147, 148 may be formed of any suitable material, and may be made of a single layer or multiple layers of, for example, non-woven materials, woven materials, and/or plastics, or any other suitable materials. The one or more flaps 146, 147, 148 may be glued, heat sealed, or otherwise permanently affixed to each other 146, 147, 148, the top rim 118, the elongated strip, and/or the air filter to form the internal valve 145. For example, in some embodiments, the internal valve 145 may be formed of multiple layers including a first layer made of a lightweight, non-woven material 146, 148 and at least a second layer made of a stiff, non-porous material 147. An adhesive strip may be provided on the filter material of the air filter 128 or elongated strip 146 protruding downwardly from the filter material 128 to secure the internal valve 145 to the air filter 128. In some embodiments, during a manufacturing process, the first layer 146, 148 of the internal valve 145 may be heat sealed or otherwise adhered to the adhesive strip provided on the filter material or elongated strip 146 of the air filter 128. A single fold or pleat 149 may be made in the first layer 146, 148 causing a first side of the first layer 146, 148 to move in a first direction toward the air filter 128 during the manufacturing process. The second layer 147 may be heat sealed or otherwise adhered to a second side opposite the first side of the first layer 146, 148.

In some embodiments, when a negative pressure is applied to or released from the air filter 128, the negative pressure via the air filter 128 may pull on or release the internal valve 145 causing the internal valve 145 to pivot at the single fold or pleat 149 between an open position 0 when the vacuum is turned on and a closed position C when the cleaning device 100 is turned off. As shown in FIG. 8C, in the closed position C, the internal valve 145 may be fully sealed against the chamber inlet opening 116 of inlet 115 of the collection chamber 112. For example, a frame portion may extend along a perimeter edge of the chamber inlet opening 116 of inlet 115 and be positioned 2±0.5 mm from the perimeter edge of the chamber inlet opening 116. In the closed position C, when the cleaning device 100 is turned off, the internal valve 145 may rest on the frame portion such that the internal valve 145 is fully sealed against the chamber inlet opening 116 of inlet 115.

Figure 10A:
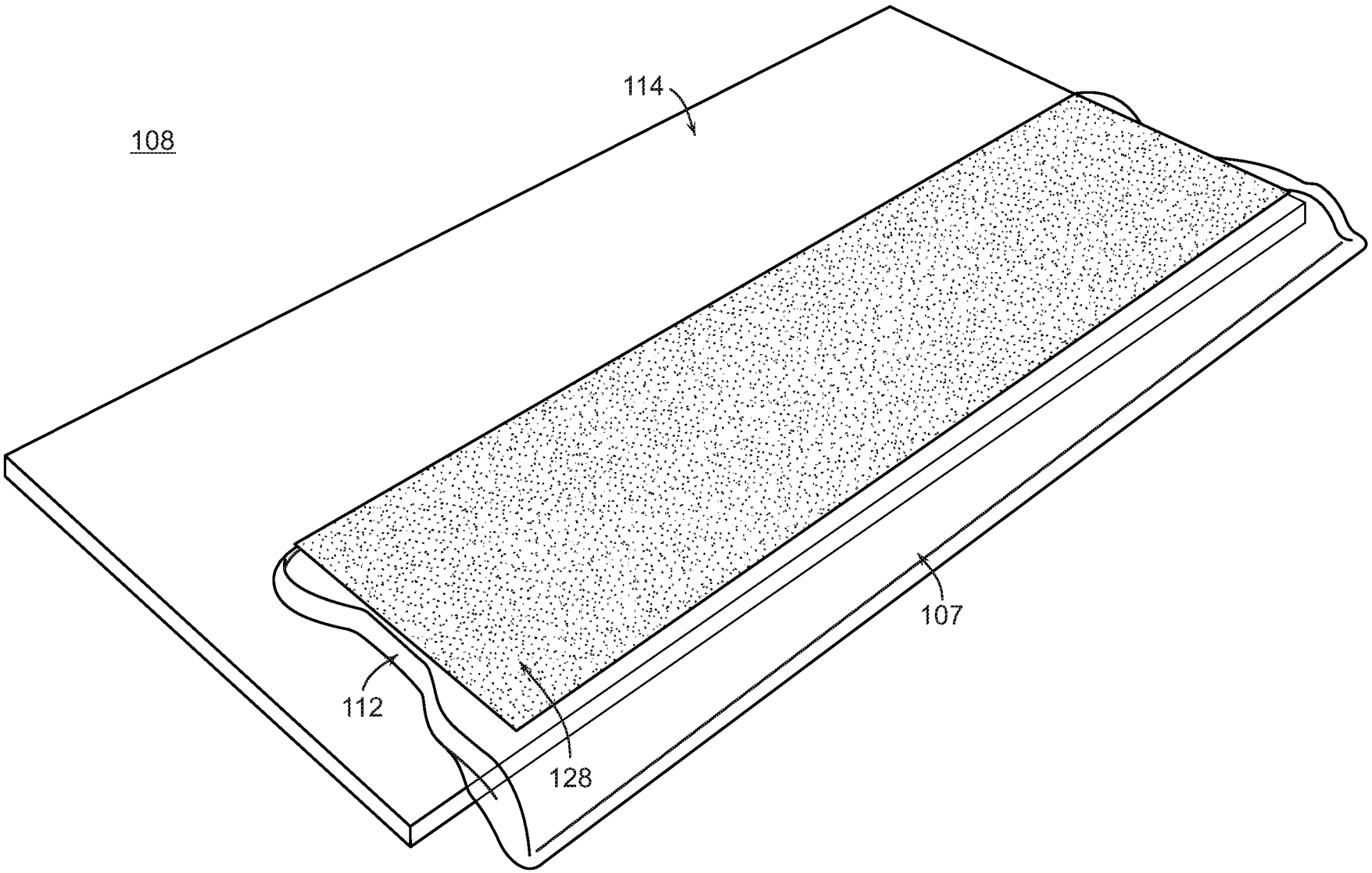
FIGS. 10A and 10B show a top, front perspective view of the cleaning head and a bottom, rear perspective view of the cleaning head according to some embodiments.
Figure 10B:
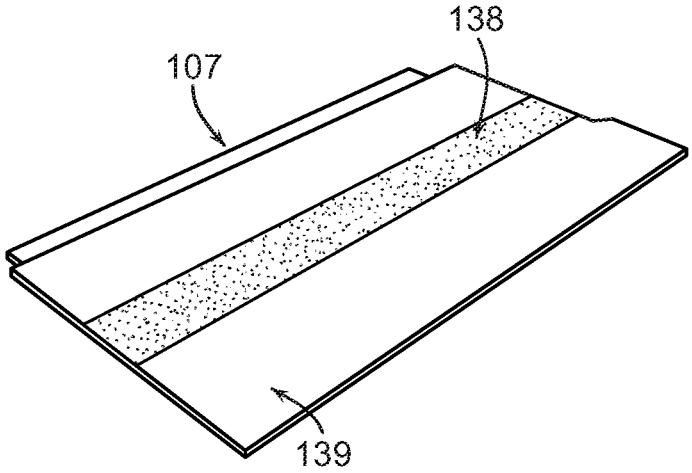
Figure 10C:
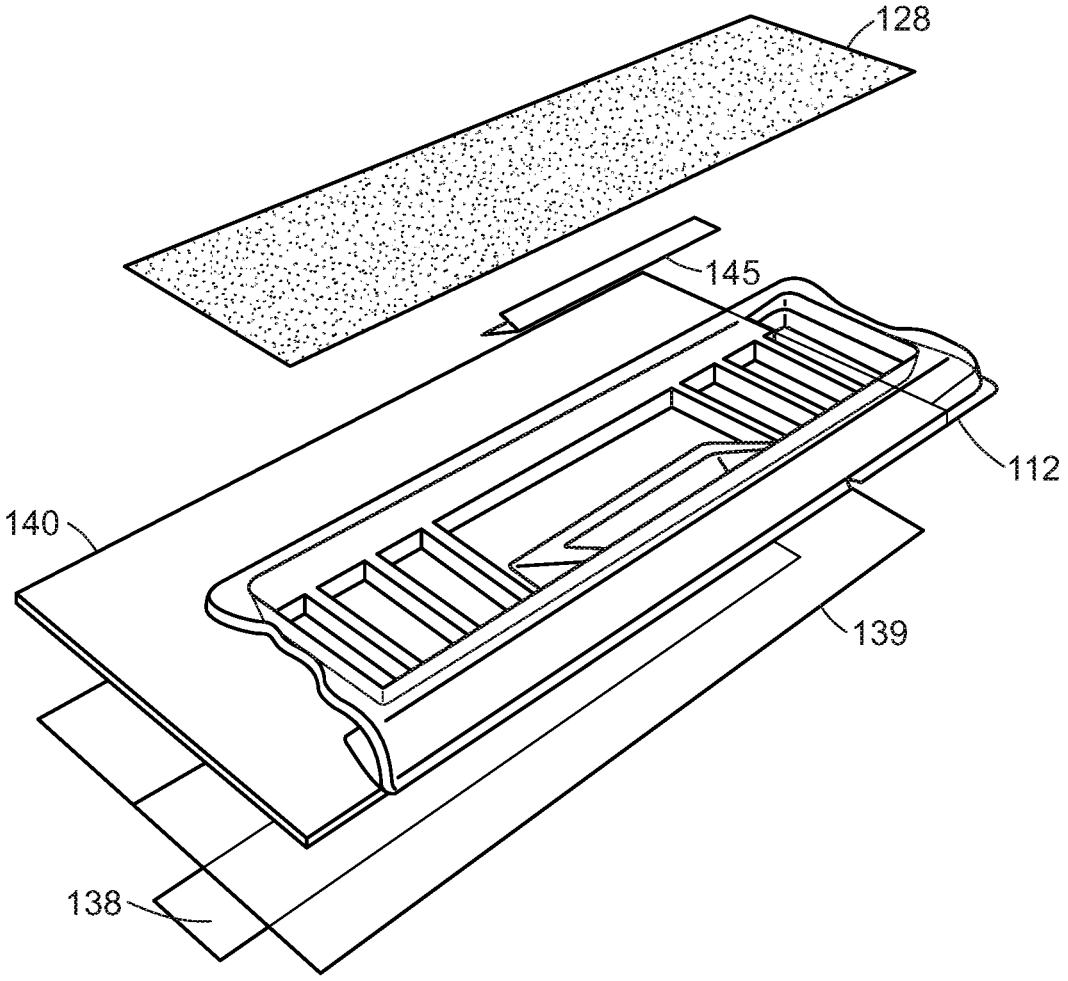
FIG. 10C is an exploded view of the cleaning head of FIG. 10A.

In some embodiments, as shown in FIGS. 10A-10C and 11 and noted above, the cleaning sheet 114 may be attached to the collection chamber 112 and be positioned behind the suction nozzle 107 such that debris may be suctioned into the nozzle 107 and collection chamber 112 before the cleaning sheet 114 reaches the debris. In the embodiment illustrated in FIGS. 10B and 10C, the cleaning sheet 114 includes multiple layers including a multifunctional strip 138, a face layer 139, and first and second absorbent layers 140 and 141. The face layer and absorbent layers may be made from various non-woven materials, woven materials, and/or plastics, or any other suitable materials. The absorbent layers may be configured to wick moisture away from the face layer. The multifunctional strip 138 may be used for scrubbing in some embodiments. In some embodiments, the multifunctional strip 138 may provide friction to help prevent the cleaning device from slipping when propped against a wall. As shown in FIG. 10C, the debris collection chamber 112 may be permanently or removably attached to the cleaning sheet 114.

Figure 9A:
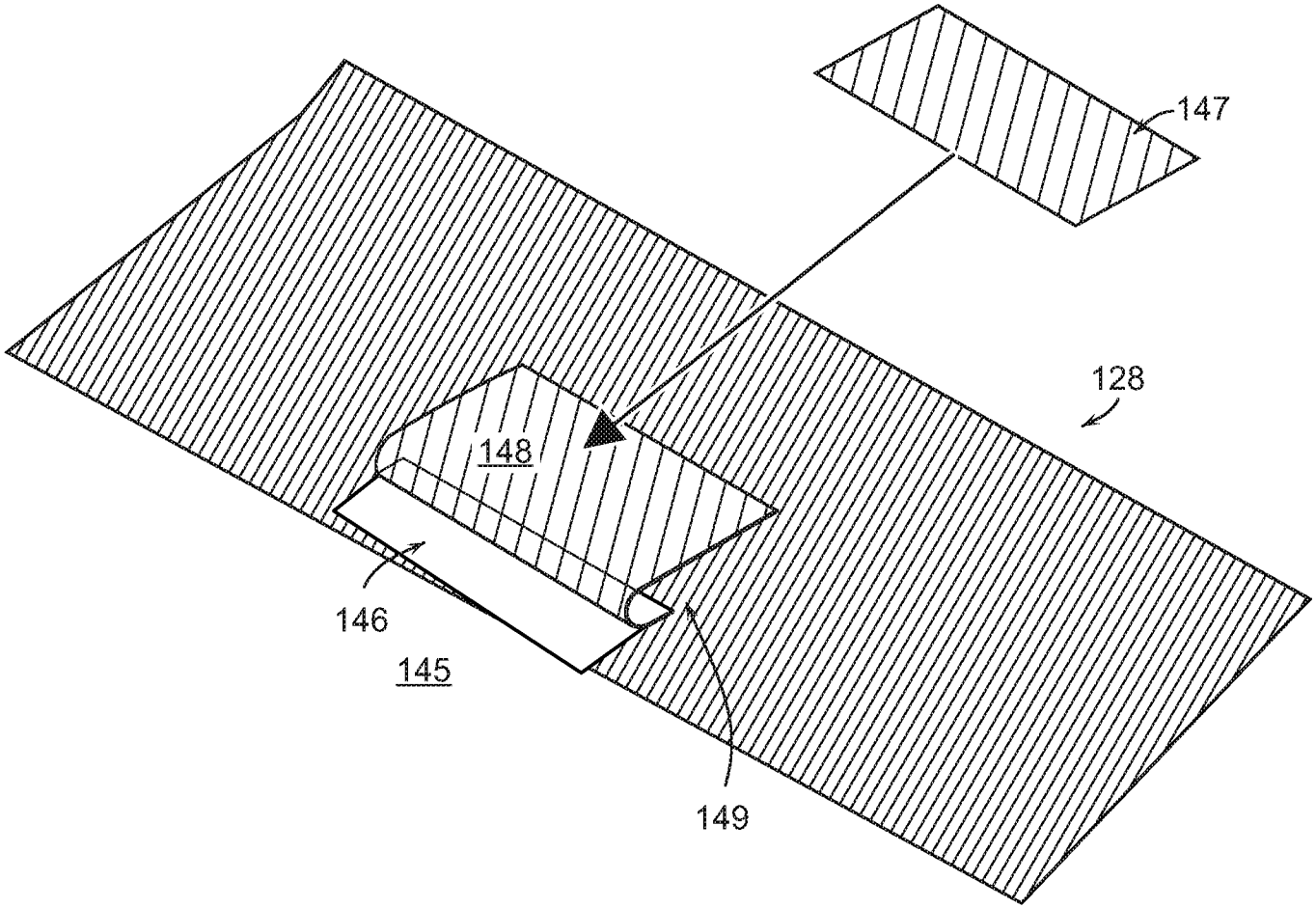
FIGS. 9A-9D are exploded views of the air filter and cleaning head of FIG. 8A according to some embodiments.
Figure 9D:
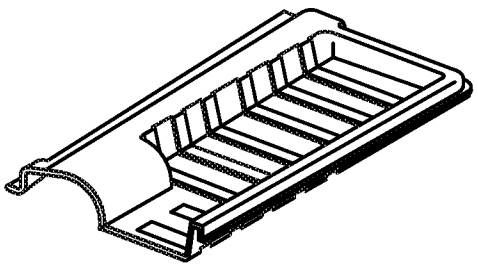
Figure 9C:
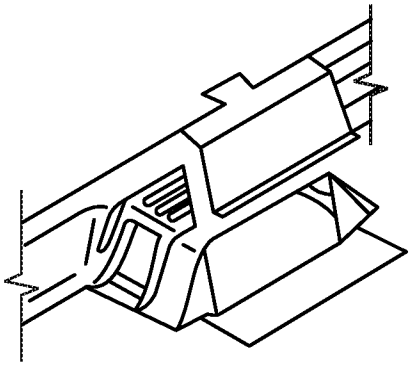
Figure 9B:
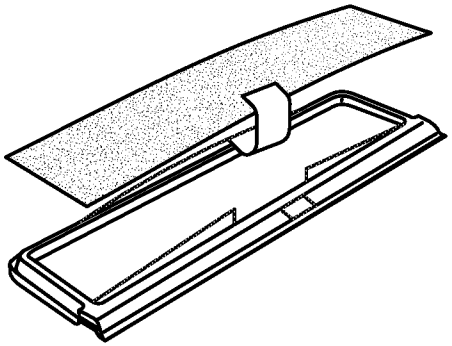
Figure 11:
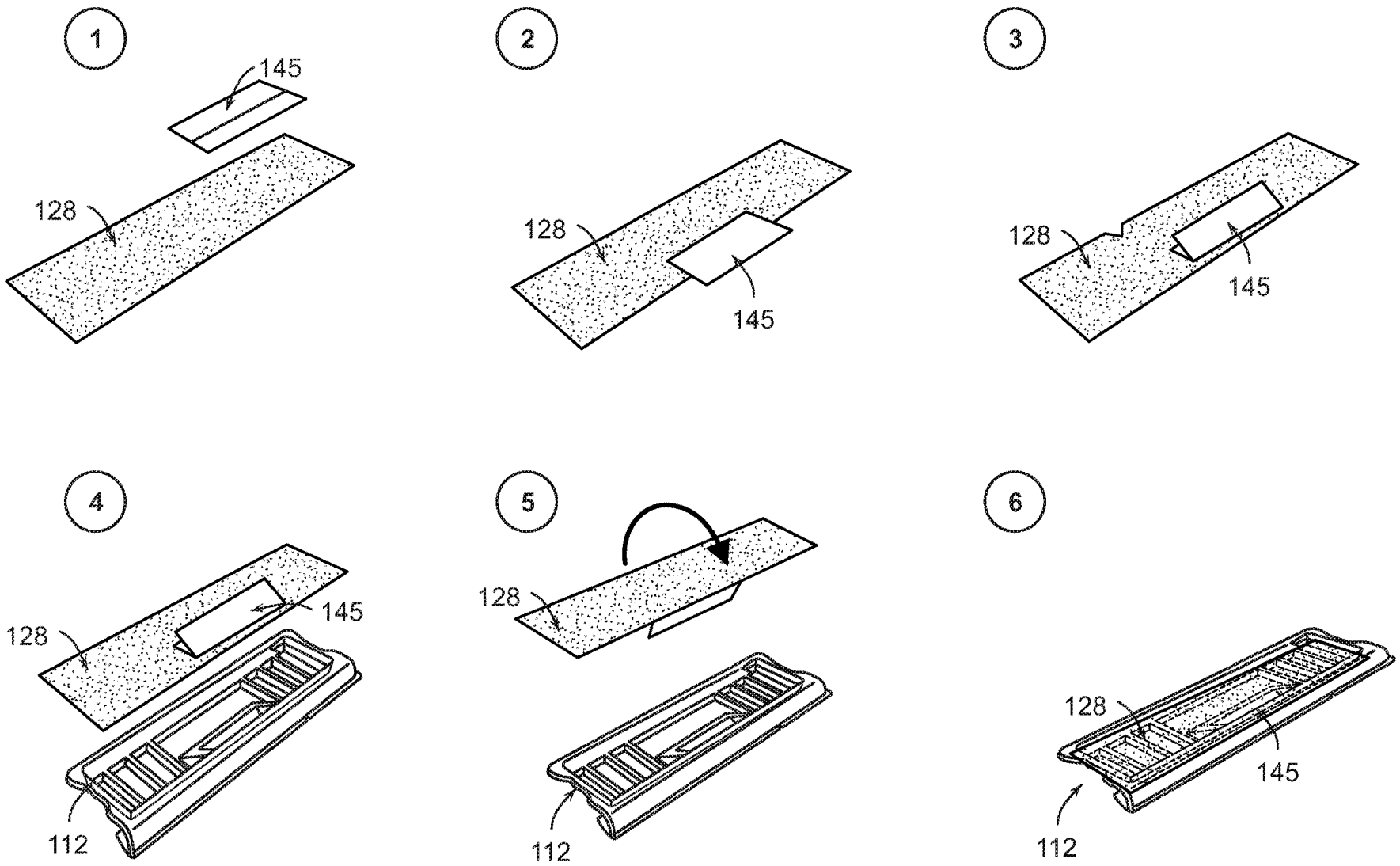
FIG. 11 shows a manufacturing process of the cleaning head of FIGS. 8A and 10A.

Referring to FIGS. 9A and 11, in some embodiments, the air filter 128 may include a first side and a second side. An adhesive strip may be provided on the first side of the air filter 128 or on an elongated strip 146 protruding downwardly from the first side of the air filter.

During a manufacturing process, the internal valve 145 may be removably or fixedly secured to the air filter 128 at the first side of the air filter 128. After the internal valve 145 is secured to the first side of the air filter 128, the air filter 128 may be rotated or flipped to a second side such that the first side of the air filter 128 faces a top side of the dirt collection chamber 112. The first side of the air filter 128 may be glued, heat sealed, or otherwise permanently affixed to the top side, including the top rim 118, of the dirt collection chamber 112. The internal valve 145 may pivot at the single fold or pleat 149 between an open position 0 when the vacuum is turned on and a closed position C when the cleaning device 100 is turned off.

Figure 12A:
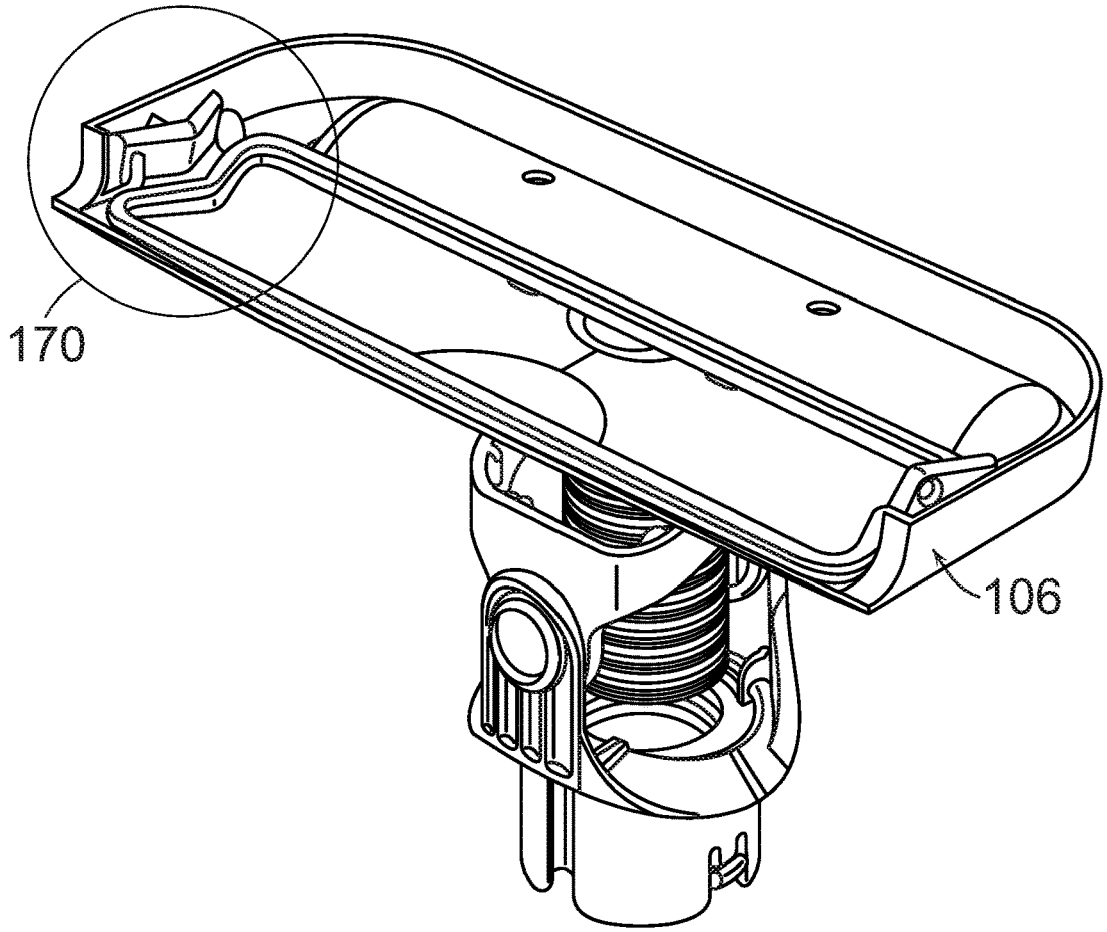
FIGS. 12A-12D show stacked cleaning heads according to some embodiments.
Figure 12B:
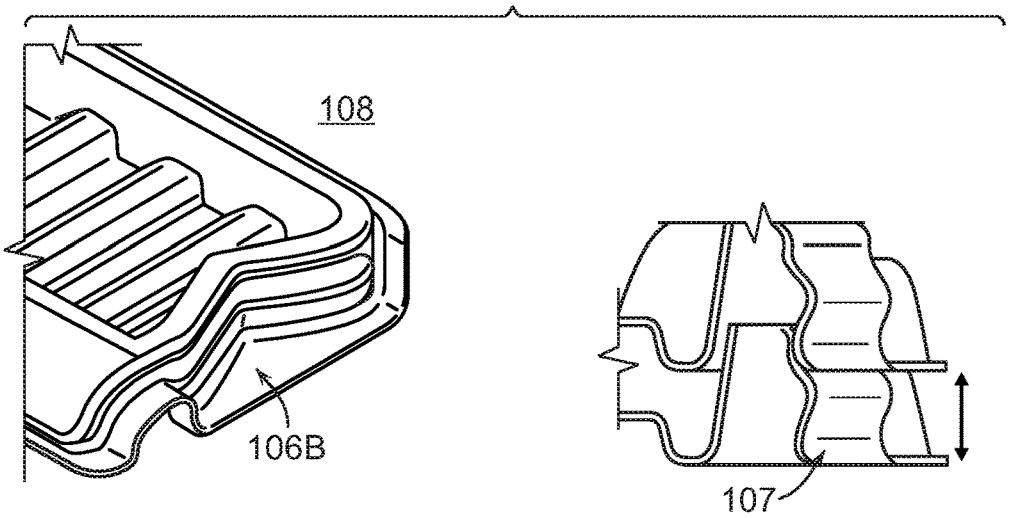
Figure 12C:
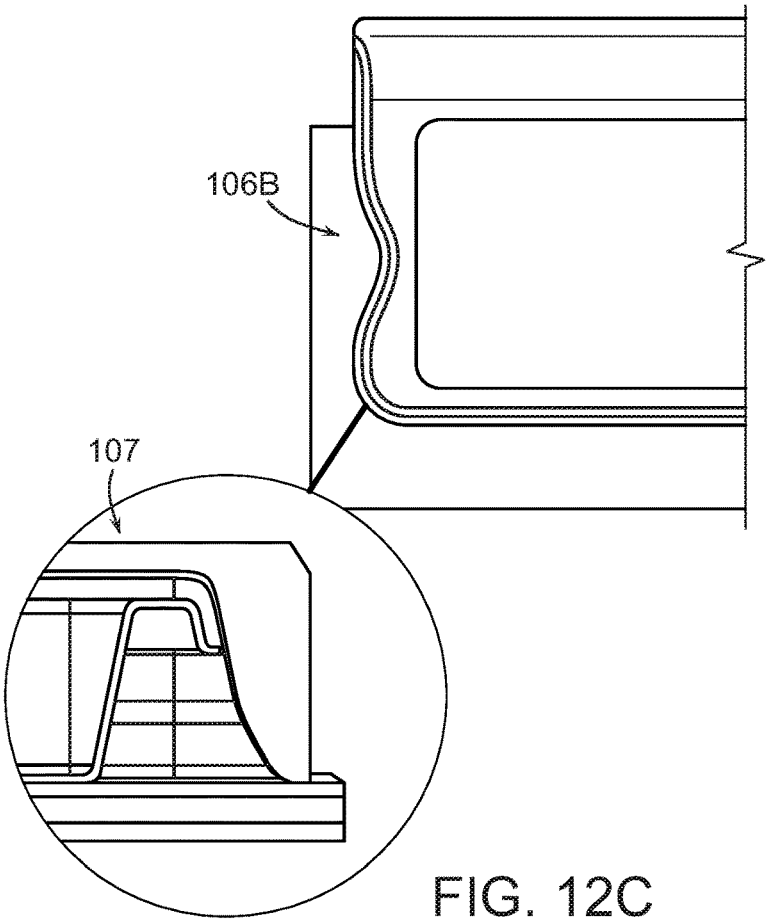

In some embodiments, when the cleaning head 108 is attached to the cleaning device 100, at least a portion of the debris collection chamber 112 may be covered by the cleaning device 100. For example, in some embodiments, the debris collection chamber 112 may be covered by the connector 106A used to connect the cleaning head 108 to the cleaning device 100. As shown in FIGS. 12A-12C, in some embodiments, the connector 106A includes an engagement element 170 that engages with a corresponding engagement element or portion 1068 of the cleaning head 108. For example, in the embodiments illustrated in FIGS. 12A-12C, the engagement element 170 may include clip portions that selectively engage and disengage an undercut bump, lip feature, or other recess 1068 formed in a side wall 120 of the debris collection chamber 112. In some embodiments, the undercut bump 1068 may include a V-shaped feature used to align and hold the cleaning head 108 and cleaning sheet 114. In some embodiments, clip portions of the engagement element 170 may be moveable between an engaged position (e.g., into engagement with the undercut bump 106B) and a released position (e.g., out of engagement with the undercut bump 106B). In some embodiments, the engagement element(s) 170 may be separately movable between the released and engaged positions. In other embodiments, the engagement element(s) 170 move simultaneously between the engaged and released positions. As will be appreciated, the engagement element(s) 170 may be biased toward the engaged position such that when the user releases an actuator, the clip portions of the engagement element(s) 170 engage with a corresponding undercut bump, lip feature, or other recess formed on an engagement element 1068 of the cleaning head 108.

A divider 160 (see FIG. 4) may be provided to stiffen the collection chamber 112, though some embodiments include no such divider. Additional walls similar to divider 160 may be positioned in the collection chamber 112 to guide air flow within the collection chamber 112. Suction nozzle 107 may extend laterally along a front portion of the cleaning head 108.

The suction nozzle 107 may have any suitable shape and size. The suction nozzle 107 may extend along an entire width of the cleaning head 108 in some embodiments.

Instead of being attached to the debris collection chamber 112, the suction nozzle 107 may be formed on part of the vacuum cleaner device 100. In such an embodiment, once the collection chamber 112 is attached to the vacuum cleaner 100, the suction nozzle 107 forms a flow path to the collection chamber inlet opening 116.

The vacuum cleaner 100 may include one or more actuators for actuating the suction source, and one or more actuators for actuating liquid application. The suction source may be an electric motor in some embodiments.

Figure 12D:
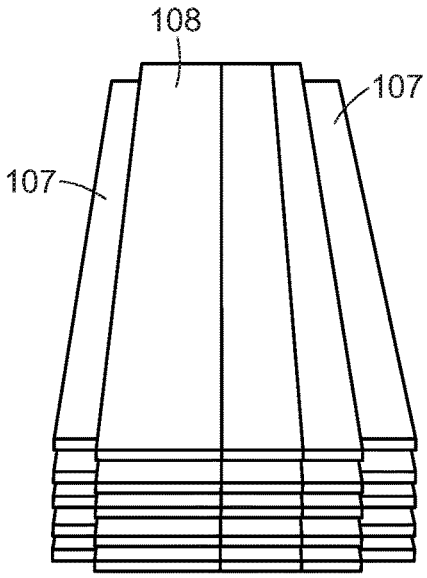

Cleaning heads 108 described herein may be constructed and arranged to permit efficient packing in some embodiments. For example, as shown in FIGS. 12B and 12D, the debris collection chamber 112 and suction nozzle 107 may be sized and positioned on a cleaning sheet 114 and/or support structure such that an inverted cleaning head 108 is stackable on an upright cleaning in such a manner that the upwardly-facing surface is substantially level. As can be seen in FIG. 12D, eight cleaning heads 108 are stacked, and the cleaning heads alternate between being upright and being inverted. The suction nozzles 107 are sized and position to not interfere with the adjacently stacked cleaning heads. In other embodiments, the engagement elements 106B may be sized and positioned such that multiple cleaning heads 108 are stackable in such a manner as to reduce an overall stack height.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An apparatus comprising:

a debris collection chamber having a chamber inlet opening configured to allow debris-entrained air to flow into the debris collection chamber;

an air filter configured to allow air to pass through the air filter while inhibiting debris in the debris collection chamber from passing through the air filter;

a flap directly coupled to the air filter that is moveable relative to the chamber inlet opening in response to a suction force applied to the debris collection chamber from a first sealed position, in which the flap covers substantially all of the chamber inlet opening, to a second unsealed position in which at least a portion of the flap is moved away from the chamber inlet opening such that at least a portion of the inlet opening is not covered.

2. An apparatus as in claim 1, wherein the air filter forms at least a portion of at least one wall of the debris collection chamber, and the air filter allows air to pass therethrough and out of the debris collection chamber.

3. An apparatus as in claim 1, wherein the flap forms at least a portion of an internal valve.

4. An apparatus as in claim 3, wherein the internal valve is adapted to be maintained in the first sealed position when no negative pressure is applied to the air filter.

5. An apparatus as in claim 4, wherein the internal valve is adapted to be moved to the second unsealed position when negative pressure is applied to the air filter to draw air through the chamber inlet opening.

6. An apparatus as in claim 5, wherein in the first sealed position the internal valve is configured to rest on a frame portion of the collection chamber inlet opening.

7. An apparatus as in claim 1, wherein the collection chamber comprises inlet walls extending upwardly from a chamber bottom, wherein the inlet opening is formed at least in part by a top rim of the inlet walls.

8. An apparatus as in claim 1, further comprising a cleaning head for a vacuum cleaner, wherein the collection chamber is attached to the cleaning head.

9. An apparatus as in claim 8, wherein the collection chamber is permanently attached to the cleaning head.

10. An apparatus as in claim 8, wherein the cleaning head includes a suction nozzle, and an air flow path connects the suction nozzle to the chamber inlet opening.

11. An apparatus as in claim 10, wherein the suction nozzle and the collection chamber are integrally formed as a unitary piece.

12. An apparatus as in claim 8, further comprising a cleaning pad attached to the cleaning head.

13. An apparatus comprising:

a debris collection chamber capable of storing debris;

a collection chamber inlet opening configured to allow debris-entrained air to flow into the debris collection chamber;

an air filter configured to allow air to pass from the debris collection chamber and through the air filter while inhibiting debris from exiting the debris collection chamber;

an internal valve movable from a first position in which the internal valve at least substantially covers the chamber inlet opening, to a second position in which the internal valve does not cover at least a portion of the chamber inlet opening; and wherein the internal valve is directly attached to a portion of the air filter.

* * * * *